US009272535B2

(12) United States Patent
Shinoda

(10) Patent No.: US 9,272,535 B2
(45) Date of Patent: Mar. 1, 2016

(54) PRINTER

(71) Applicant: Brother Kogyo Kabushiki Kaisha, Nagoya-shi, Aichi-ken (JP)

(72) Inventor: Noriko Shinoda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/637,454

(22) Filed: Mar. 4, 2015

(65) Prior Publication Data

US 2015/0251461 A1 Sep. 10, 2015

(30) Foreign Application Priority Data

Mar. 4, 2014 (JP) ..... 2014-042202

(51) Int. Cl.
*B41J 2/01* (2006.01)
*B41J 3/407* (2006.01)

(52) U.S. Cl.
CPC ..... *B41J 3/4075* (2013.01)

(58) Field of Classification Search
CPC ..... B41J 3/4075; B41J 11/008; B41J 15/04; B41J 15/044; B41J 2/325; B65H 49/00; Y10T 156/17
USPC ..... 347/4, 5, 16, 104, 177, 217
See application file for complete search history.

(56) References Cited

U.S. PATENT DOCUMENTS

| | | | | |
|---|---|---|---|---|
| 5,262,799 | A * | 11/1993 | Ono et al. | 347/180 |
| 7,230,635 | B2 | 6/2007 | Kawamoto | |
| 7,277,109 | B2 * | 10/2007 | Ueda | 347/177 |
| 2005/0280691 | A1 | 12/2005 | Kawamoto | |
| 2011/0292150 | A1 * | 12/2011 | Ishii et al. | 347/110 |
| 2013/0292060 | A1 | 11/2013 | Tanaka | |

FOREIGN PATENT DOCUMENTS

| | | | |
|---|---|---|---|
| EP | 2660062 | A1 | 11/2013 |
| JP | 2006-001102 | A | 1/2006 |
| JP | 2013-233661 | A | 11/2013 |

* cited by examiner

*Primary Examiner* — Anh T. N. Vo
(74) *Attorney, Agent, or Firm* — Banner & Witcoff, Ltd.

(57) ABSTRACT

This is disclosed a printer comprising a feeder, a printing head, a take-up body, and a print control portion. The feeder feeds a recording medium. The printing head forms desired print in a predetermined print area of the recording medium fed by the feeder. The take-up body sequentially takes up the recording medium on an outer circumference part with a tip end region of the recording medium positioned on downstream side in a transport direction than the print area connected to the outer circumference part and produces a roll-shaped printed matter. The print control portion controls the printing head so as to form a print part for preheating the printing head in a position that serves as a border between the tip end region and the print area of the recording medium.

11 Claims, 18 Drawing Sheets

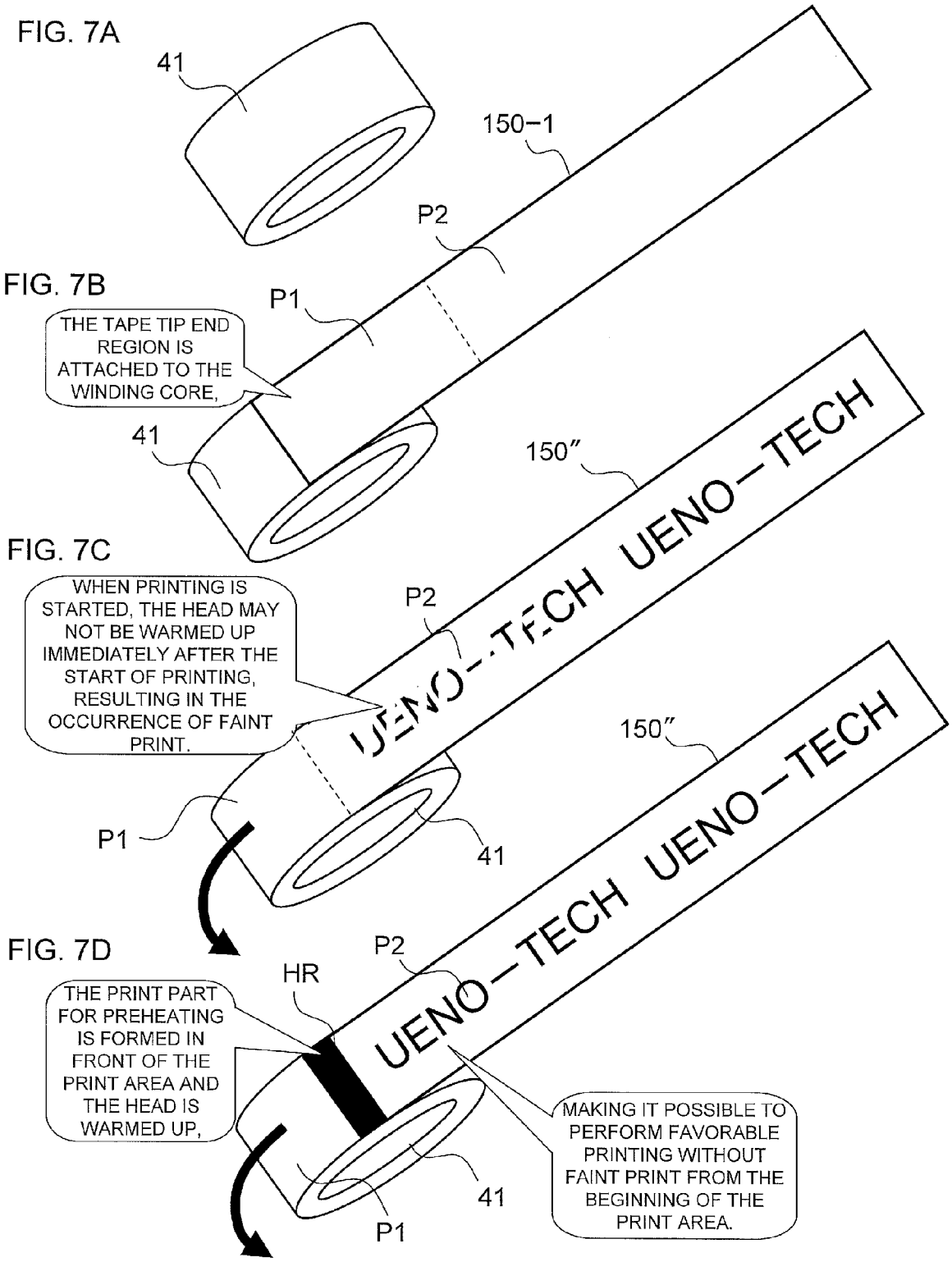
FIG. 7A
41
150-1
P2
FIG. 7B
P1
THE TAPE TIP END REGION IS ATTACHED TO THE WINDING CORE,
41
150″
UENO-TECH UENO-TECH
FIG. 7C
WHEN PRINTING IS STARTED, THE HEAD MAY NOT BE WARMED UP IMMEDIATELY AFTER THE START OF PRINTING, RESULTING IN THE OCCURRENCE OF FAINT PRINT.
P2
150″
P1
41
UENO-TECH UENO-TECH
FIG. 7D
P2
HR
THE PRINT PART FOR PREHEATING IS FORMED IN FRONT OF THE PRINT AREA AND THE HEAD IS WARMED UP,
UENO-TECH
MAKING IT POSSIBLE TO PERFORM FAVORABLE PRINTING WITHOUT FAINT PRINT FROM THE BEGINNING OF THE PRINT AREA.
41
P1

COMPARISON EXAMPLE

PRINTER

CROSS-REFERENCE TO RELATED APPLICATION

The present application claims priority from Japanese Patent Application No. 2014-042202, which was filed on Mar. 4, 2014, the disclosure of which is incorporated herein by reference in its entirety.

BACKGROUND

1. Field

The present disclosure relates to a printer that performs printing on a recording medium.

2. Description of the Related Art

There are known printers that form desired print on a print-receiving tape. According to this printer, when the print-receiving tape is fed by a feeding roller, desired print is formed on the fed print-receiving tape by a printing head. The print-receiving tape on which print has been formed is sequentially taken up around a winding core by take-up means, thereby producing a roll-shaped printed matter.

In general, in a case where print formation is performed by a printing head, heating elements included in the printing head may not be sufficiently warmed up immediately after the start of printing, resulting in a decrease in print quality, such as the occurrence of faint print and the like. If the printed matter is thus produced by take-up of the print-receiving tape as in the prior art and the faint print or the like is found after production of the printed matter, the problem arises that the printed matter generated by take-up becomes a defective product, resulting in waste.

SUMMARY

It is therefore an object of the present disclosure to provide a printer capable of suppressing faint print and the like, thereby improving the print quality and suppressing the occurrence of defective products in printed matter generated by take-up.

In order to achieve the above-described object, according to an aspect of the present application, there is provided a printer comprising a feeder configured to feed a recording medium, a printing head configured to form desired print in a predetermined print area of the recording medium fed by the feeder, a take-up body configured to sequentially take up the recording medium on an outer circumference part with a tip end region of the recording medium positioned on downstream side in a transport direction than the print area connected to the outer circumference part and to produce a roll-shaped printed matter, and a print control portion configured to control the printing head so as to form a print part for preheating the printing head in a position that serves as a border between the tip end region and the print area of the recording medium.

In the printer in the present disclosure, when a recording medium is fed by a feeder, desired print is formed on the fed recording medium by the printing head. The recording medium on which print has been formed is sequentially taken up around the winding core by a take-up body, thereby producing a roll-shaped printed matter.

Hence, in general, in a case where print formation is performed by a printing head, heating elements included in the printing head may not be sufficiently warmed up immediately after the start of printing, resulting in a decrease in print quality, such as the occurrence of faint print and the like. If printed matter is produced by take-up of the recording medium as described above and the faint print or the like is found after production of the printed matter, the printed matter generated by take-up becomes a defective product, resulting in waste.

Hence, in the present disclosure, a print control portion that controls the printing head is provided. The printing head forms a print part for preheating in a position of the recording medium that serves as the border between the print area in which desired print such as described above is formed and a tip end region connected to the winding core on the tip end side (the transport direction downstream side), based on the control of the print control portion. With this arrangement, the printing head forms the print part in the position that serves as the border (prior to forming desired print in the print area as described above), thereby making it possible to execute print formation in the print area with the printing head sufficiently warmed up by the formation operation. As a result, it is possible to suppress the occurrence of faint print such as described above and the like, and improve print quality. This makes it possible to suppress the occurrence of defective products in printed matter generated by take-up.

Further, due to the print part, the border between the tip end region, which is the tape section mainly used for connection to the winding core and not provided for substantial use by the user, and the print area which serves as the tape section substantially provided for use by the user, can also be visually clearly defined.

BRIEF DESCRIPTION OF THE DRAWINGS

FIG. 7A is an explanatory view showing the tip end region of the print-receiving tape being attached to the winding core and printing performed in a comparison example of an embodiment of the present disclosure.

FIG. 7B is an explanatory view showing the tip end region of the print-receiving tape being attached to the winding core and printing performed in the comparison example of an embodiment of the present disclosure.

FIG. 7C is an explanatory view showing the tip end region of the print-receiving tape being attached to the winding core and printing performed in the comparison example of an embodiment of the present disclosure.

FIG. 7D is an explanatory view showing printing performed in an embodiment.

DETAILED DESCRIPTION OF THE PREFERRED EMBODIMENTS

Figure 1:
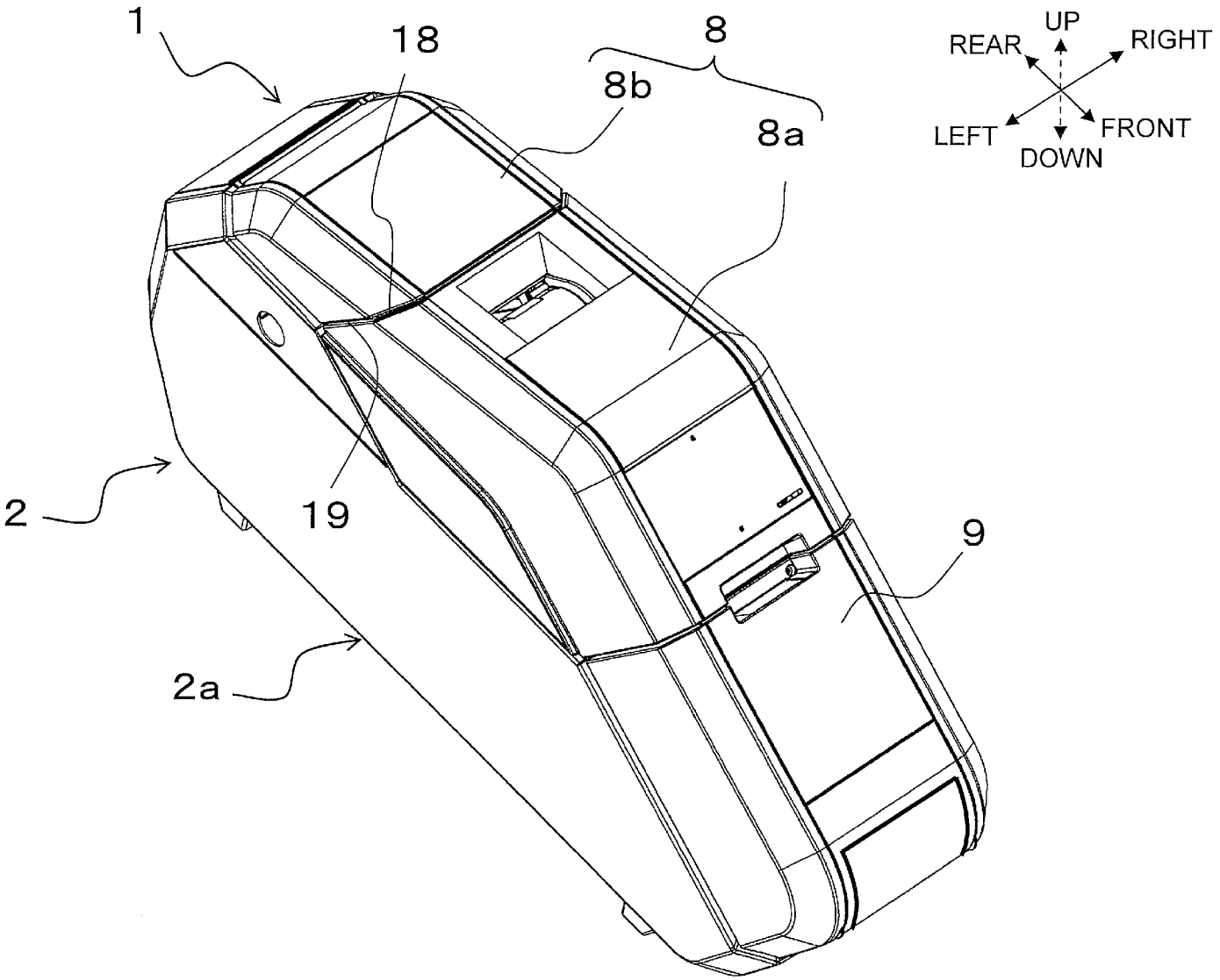
FIG. 1 is a perspective view showing the outer appearance of the tape printer related to an embodiment of the present disclosure.

The following describes an embodiment of the present disclosure with reference to accompanying drawings. Note that, in a case where "Front," "Rear," "Left," "Right," "Up," and "Down" are denoted in the drawings, the terms "Frontward (Front)," "Rearward (Rear)," "Leftward (Left)," "Rightward (Right)," "Upward (Up)," and "Downward (Down)" in the explanations of the description refer to the denoted directions.

General Configuration of Tape Printer

First, the general configuration of the tape printer related to this embodiment will be described with reference to FIGS. 1-4.

Housing

In FIGS. 1-4, a tape printer 1 in this embodiment comprises a housing 2 that constitutes the apparatus outer contour. The housing 2 comprises a housing main body 2*a*, a rearward-side opening/closing part 8, and a frontward-side opening/closing cover 9.

The housing main body 2*a* comprises a first storage part 3 disposed on the rearward side, and a second storage part 5 and a third storage part 4 disposed on the frontward side.

The rearward-side opening/closing part 8 is connected to an upper area of the rearward side of the housing main body 2*a* in an openable and closeable manner. This rearward-side opening/closing part 8 is capable of opening and closing the area above the first storage part 3 by pivoting. The rearward-side opening/closing part 8 includes a first opening/closing cover 8*a* and a second opening/closing cover 8*b*.

The first opening/closing cover 8*a* is capable of opening and closing the area above the frontward side of the first storage part 3 by pivoting around a predetermined pivot axis K1 disposed in the upper area of the rearward side of the housing main body 2*a*. Specifically, the first opening/closing cover 8*a* is capable of pivoting from a closed position (the states in FIGS. 1 and 2) in which it covers the area above the frontward side of the first storage part 3, to an open position (the states in FIGS. 3 and 4) in which it exposes that area.

Figure 2:
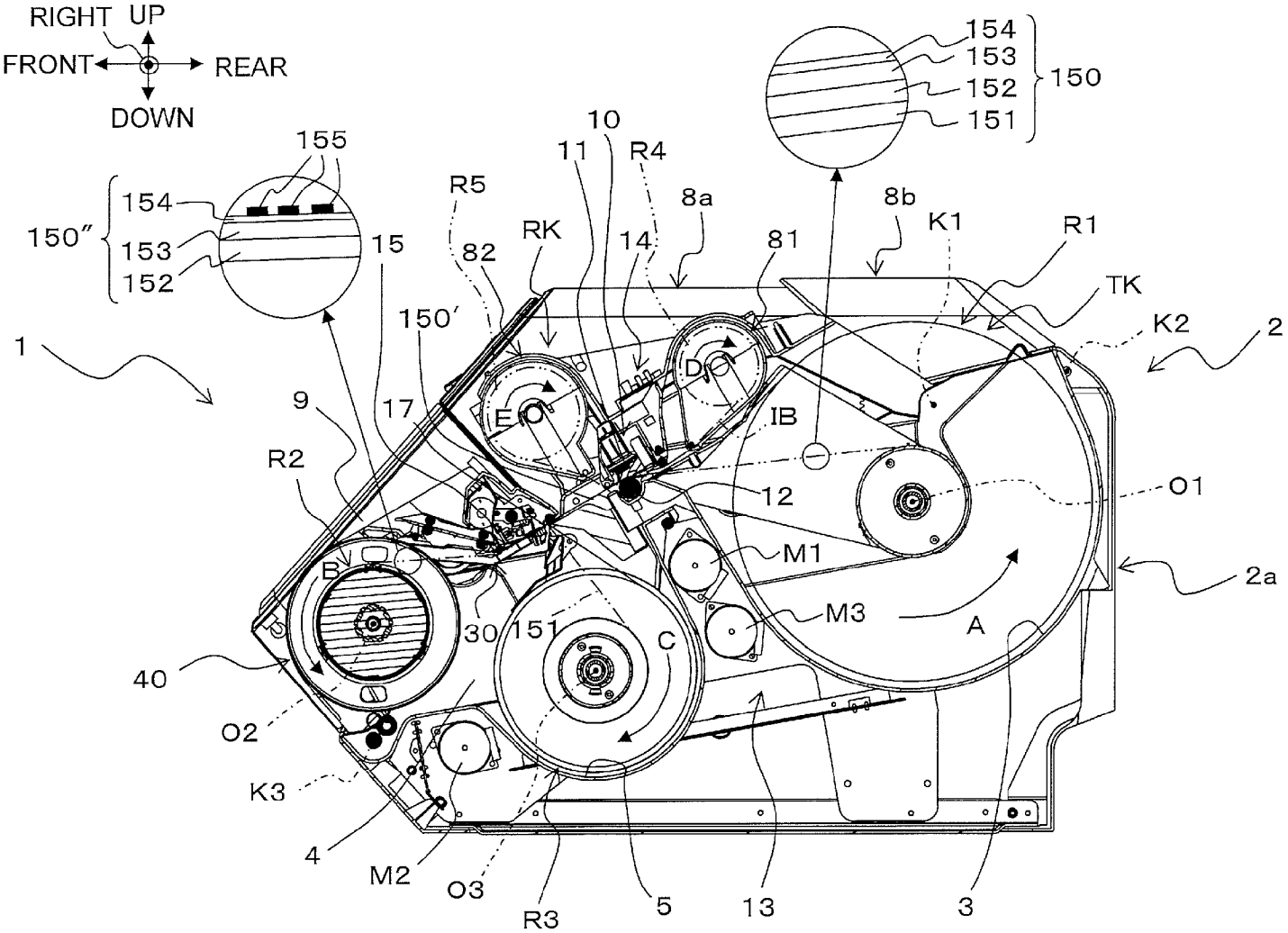
FIG. 2 is a side cross-sectional view showing the internal structure of the tape printer.
Figure 3:
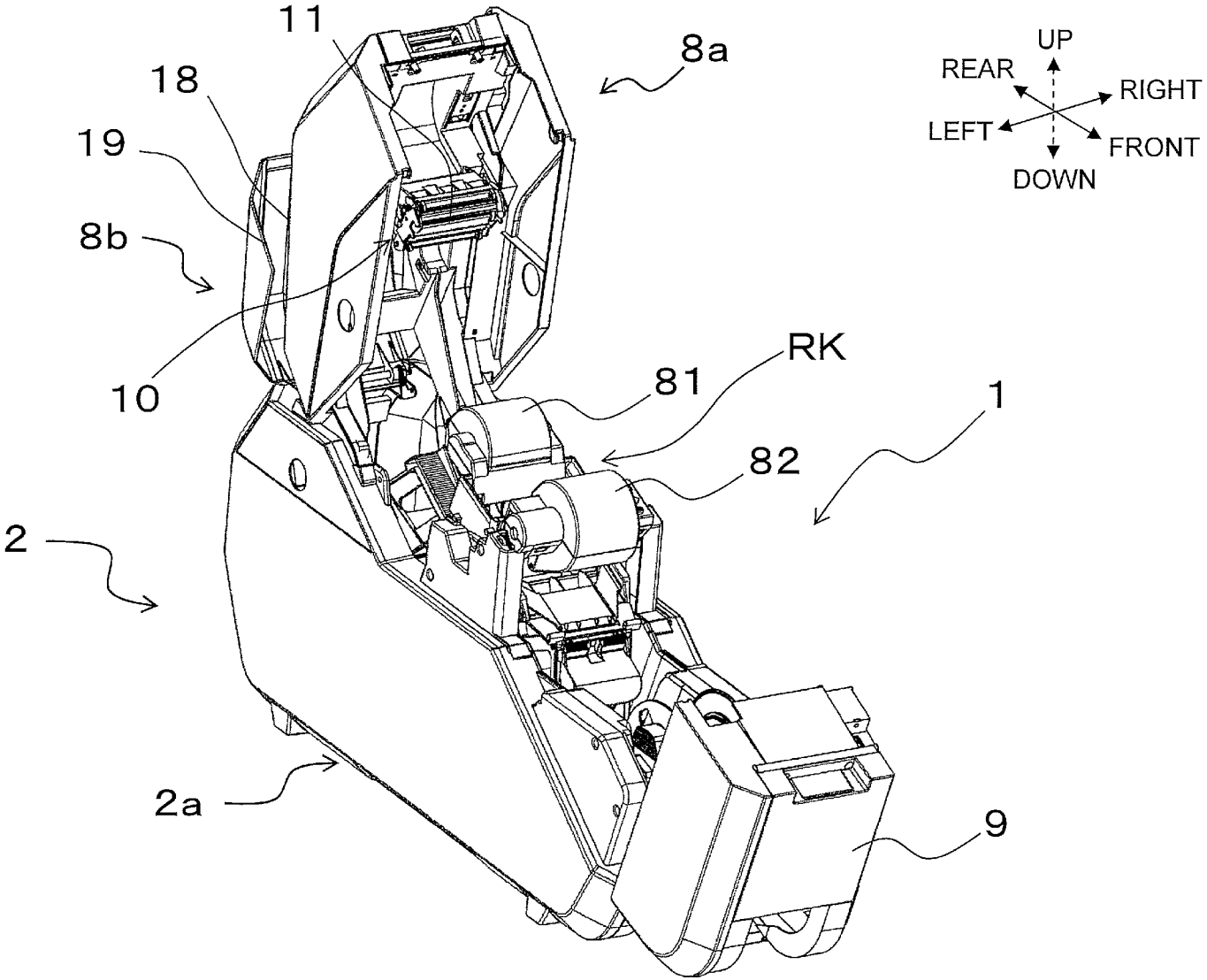
FIG. 3 is a perspective view showing the outer appearance of the tape printer with the first, second, and frontward-side opening/closing covers open.

A head holding body 10 is disposed in the interior of the first opening/closing cover 8*a* (refer to FIG. 3 as well). Then, the first opening/closing cover 8*a* pivots around the above described pivot axis K1, making it possible to move a printing head 11 included in the head holding body 10 relatively closer to or farther away from a feeding roller 12 disposed in the housing main body 2*a*. That is, the printing head 11 moves close to the feeding roller 12 in the above described closed position (the states in FIGS. 1 and 2) of the first opening/closing cover 8*a*, and moves away from the feeding roller 12 in the above described open position (the states in FIGS. 3 and 4) of the first opening/closing cover 8*a*.

The second opening/closing cover 8*b* is disposed further on the rearward side than the above described first opening/closing cover 8*a*, and is capable of opening and closing the area above the rearward side of the first storage part 3 separately from the opening and closing of the above described first opening/closing cover 8*a* by pivoting around a predetermined pivot axis K2 disposed on the upper end of the rearward side of the housing main body 2*a*. Specifically, the second opening/closing cover 8*b* is capable of pivoting from a closed position (the states in FIGS. 1 and 2) in which it covers the area above the rearward side of the first storage part 3, to an open position (the states in FIGS. 3 and 4) in which it exposes that area.

Then, the first opening/closing cover 8*a* and the second opening/closing cover 8*b* are configured so that, when each is closed, an outer circumference part 18 of the first opening/closing cover 8*a* and an edge part 19 of the second opening/closing cover 8*b* substantially contact each other and cover almost the entire area above the first storage part 3.

The frontward-side opening/closing cover 9 is connected to the upper area of the frontward side of the housing main body 2*a* in an openable and closeable manner. The frontward-side opening/closing cover 9 is capable of opening and closing the area above the third storage part 4 by pivoting around a predetermined pivot axis K3 disposed on the upper end of the frontward side of the housing main body 2*a*. Specifically, the frontward-side opening/closing cover 9 is capable of pivoting from a closed position (the states in FIGS. 1 and 2) in which it covers the area above the third storage part 4, to an open position (the states in FIGS. 3 and 4) in which it exposes that area.

Print-Receiving Tape Roll and Surrounding Area Thereof

Figure 4:
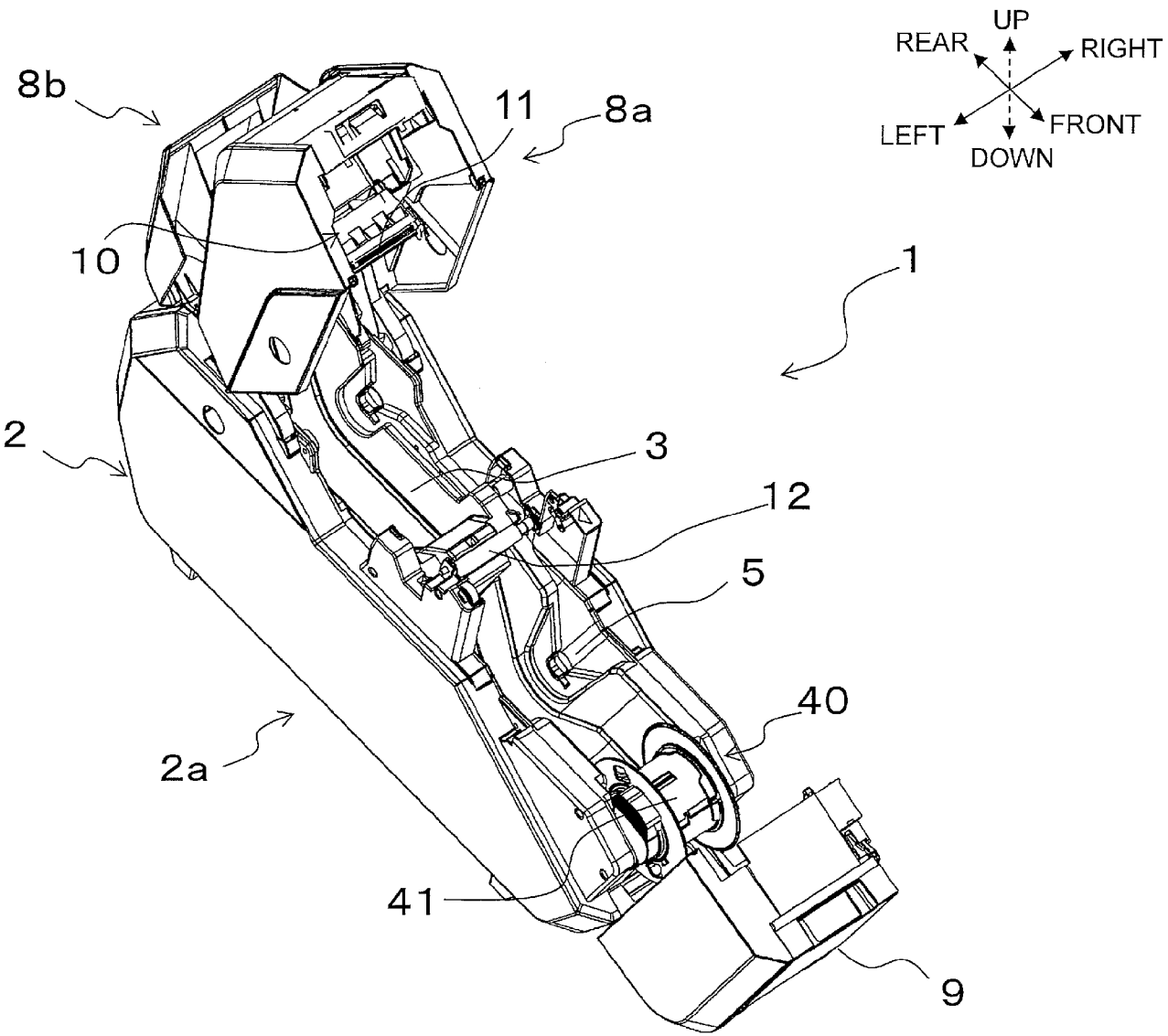
FIG. 4 is a perspective view showing the tape printer with the first, second, and frontward-side opening/closing covers open and the tape cartridge and ink ribbon cartridge removed.

At this time, as shown in FIGS. 2-4, a tape cartridge TK (refer to FIG. 2) is detachably mounted in a first predetermined position 13 below the frontward-side opening/closing cover 9 (when closed) of the housing main body 2*a*. This tape cartridge TK comprises a first roll R1 wound around and formed on an axis O1.

Figure 5:
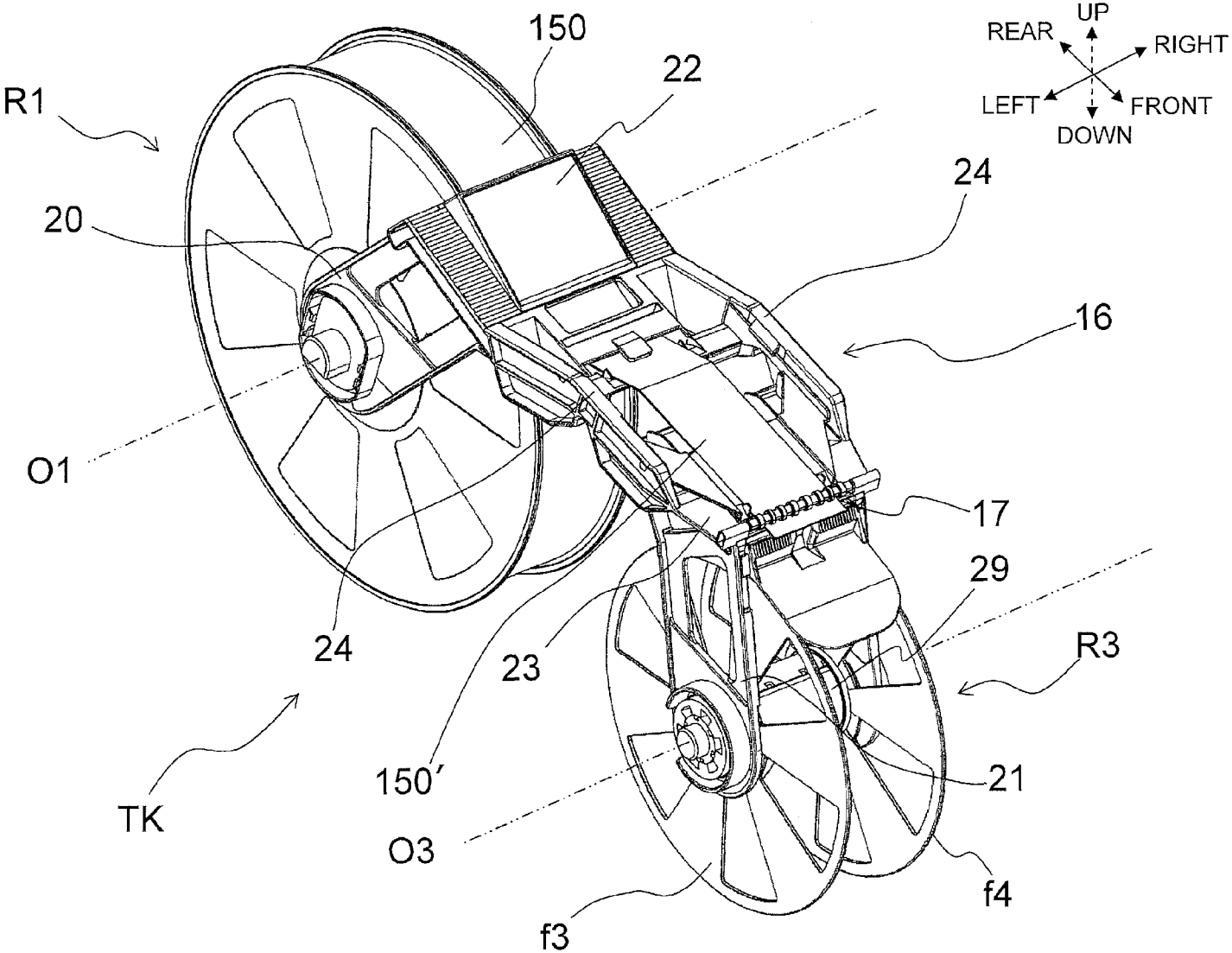
FIG. 5 is a perspective view showing the overall configuration of the tape cartridge.

That is, the tape cartridge TK comprises the first roll R1 and a coupling arm 16, as shown in FIG. 5. The coupling arm 16 comprises a left and right pair of first bracket parts 20, 20 disposed on the rearward side, and a left and right pair of second bracket parts 21, 21 disposed on the frontward side.

The first bracket parts 20, 20 are set so that the above described first roll R1 is sandwiched from both the left and right sides along the axis O1, holding the first roll R1 rotatably around the axis O1 with the tape cartridge TK mounted to the housing main body 2*a*. These first bracket parts 20, 20 are connected by a first connecting part 22 that is extended substantially along the left-right direction on the upper end, avoiding interference with the outer diameter of the first roll R1.

The first roll R1 is rotatable when the tape cartridge TK is mounted in the interior of the housing main body 2*a*. The first roll R1 winds a print-receiving tape 150 (comprising a print-receiving layer 154, a base layer 153, an adhesive layer 152, and a separation material layer 151 described later; refer to the enlarged view in FIG. 2) consumed by feed-out around the axis O1 in the left-right direction in advance.

The first roll R1 is received in the first storage part 3 from above by the mounting of the above described tape cartridge TK and stored with the axis O1 of the winding of the print-receiving tape 150 in the left-right direction. Then, the first roll R1, stored in the first storage part 3 (with the tape cartridge TK mounted), rotates in a predetermined rotating direction (a direction A in FIG. 2) inside the first storage part 3, thereby feeding out the print-receiving tape 150.

This embodiment illustrates a case where a print-receiving tape 150 comprising adhesive is used. That is, the print-receiving tape 150 is layered in the order of the print-receiving layer 154, the base layer 153, the adhesive layer 152, and the separation material layer 151, from one side in the thickness direction (upward side in FIG. 2) toward the other side (downward side in FIG. 2). The print-receiving layer 154 is a layer in which a desired print part 155 (refer to the enlarged partial view in FIG. 2) is formed by the heat transfer of ink from the above described printing head 11. The adhesive layer 152 is a layer for affixing the base layer 153 to a suitable adherent (not shown). The separation material layer 151 is a layer that covers the adhesive layer 152.

Feeding Roller and Printing Head

Returning to FIGS. 2-4, the above described feeding roller 12 is disposed on a middle upward side of the first storage part 3 and the second storage part 5 of the housing main body 2*a*. The feeding roller 12 is driven by a feeding motor M1 disposed in the interior of the housing main body 2*a* via a gear mechanism (not shown), thereby feeding the print-receiving tape 150 fed out from the first roll R1 stored in the first storage part 3 in a tape posture in which the tape width direction is in the left-right direction.

Further, the above described head holding part 10 disposed on the first opening/closing cover 8*a* comprises the above described printing head 11. The printing head 11, as described above, is capable of moving relatively closer to or farther away from the feeding roller 12 by the pivoting of the first opening/closing cover 8*a* around the pivot axis K1. That is, the printing head 11 moves closer to the feeding roller 12 when the first opening/closing cover 8*a* is closed, and farther away from the feeding roller 12 when the first opening/closing cover 8*a* is opened. This printing head 11 is disposed in a position of the head holding part 10 that faces the area above the feeding roller 12, with the first opening/closing cover 8*a* closed, sandwiching the print-receiving tape 150 fed by the feeding roller 12 in coordination with the feeding roller 12. Accordingly, when the first opening/closing cover 8*a* is closed, the printing head 11 and the feeding roller 12 are disposed facing each other in the up-down direction. Then, the printing head 11 forms the above described print part 155 (specifically, including a print RR, notation characters L1, L2, and a print part HR for preheating described later; hereinafter the same) on the print-receiving layer 154 of the print-receiving tape 150 sandwiched between the printing head 11 and the feeding roller 12 using an ink ribbon IB of an ink ribbon cartridge RK described later, thereby forming a tape 150' with print.

Ink Ribbon Cartridge

As shown in FIG. 2 and FIG. 3, the ink ribbon cartridge RK is detachably mounted in a second predetermined position 14, which is below the first opening/closing cover 8*a* (when closed) and above the tape cartridge TK in the housing main body 2*a*. This ink ribbon cartridge RK comprises a ribbon feed-out roll R4 around which is wound the unused ink ribbon IB in manner that enables feed-out, and a ribbon take-up roll R5. The ink ribbon cartridge RK couples a rearward-side feed-out roll storage part 81 and a frontward-side take-up roll storage part 82 by a center coupling part (not shown). The coupling part couples the above described take-up roll storage part 82 and the above described feed-out roll storage part 81 while exposing the above described ink ribbon IB fed out from the ribbon feed-out roll R4 to the outside of the ink ribbon cartridge RK.

The ribbon feed-out roll R4 is rotatably supported inside the feed-out roll storage part 81, and rotates in a predetermined rotating direction (a direction D in FIG. 2) with the ink ribbon cartridge RK mounted, thereby feeding out the ink ribbon IB for print formation by the printing head 11.

The ribbon take-up roll R5 is rotatably supported inside the take-up roll storage part 82 and rotates in a predetermined rotating direction (a direction E in FIG. 2) with the ink ribbon cartridge RK mounted, thereby taking up the used ink ribbon IB after print formation.

That is, in FIG. 2, the ink ribbon IB fed out from the ribbon feed-out roll R4 is disposed further on the printing head 11 side of the print-receiving tape 150 sandwiched between the printing head 11 and the feeding roller 12, contacting the area below the printing head 11. Then, after the ink of an ink ribbon IB is transferred to the print-receiving layer 154 of the print-receiving tape 150 by the heat from the printing head 11 to execute formation of the print part 155, the used ink ribbon IB is taken up on the ribbon take-up roll R5.

Separation Material Roll and Surrounding Area Thereof

As shown in FIG. 5, the coupling arm 16 of the tape cartridge TK comprises a peeling part 17 that includes a substantially horizontal slit shape, for example. This peeling part 17 is an area that peels the separation material layer 151 from the tape 150' with print fed out from the first roll R1 and fed to the frontward side. As shown in FIG. 2, the above described peeling part 17 peels the above described separation material layer 151 from the tape 150' with print on which print was formed as described above, thereby separating the separation material layer 151 and a tape 150" with print made of the other layers, i.e., the print-receiving layer 154, the base layer 153, and the adhesive layer 152.

The tape cartridge TK, as shown in FIG. 2 and FIG. 5, comprises a third roll R3 formed by winding the above described peeled separation material layer 151 around an axis O3. That is, the third roll R3 is received in the above described second storage part 5 from above by the mounting of the aforementioned tape cartridge TK and stored with the axis O3 for winding the separation material layer in the left-right direction. Then, the third roll R3, stored in the second storage part 5 (with the tape cartridge TK mounted), is driven by a separation sheet take-up motor M3 that is disposed inside the housing main body 2*a* via a gear mechanism (not shown) and rotates in a predetermined rotating direction (a direction C in FIG. 2) inside the second storage part 5, thereby taking up the separation material layer 151.

At this time, as shown in FIG. 5, the above described second bracket parts 21, 21 of the tape cartridge TK are set so that the above described third roll R3 is sandwiched from both the left and right sides along the axis O3, holding the third roll R3 rotatably around the axis O3 with the tape cartridge TK mounted to the housing main body 2*a*. These second bracket parts 21, 21 are connected by a second connecting part 23 extended substantially along the left-right direction on the upper end. Then, the first bracket parts 20, 20 and the first connecting part 22 on the rearward side, and the second bracket parts 21, 21 and the second connecting part 23 on the frontward side are coupled by a left and right pair of roll coupling beam parts 24, 24.

Further, FIG. 5 shows the state before the separation material layer 151 is wound around the axis O3 and the third roll R3 is formed (the case of the unused tape cartridge TK). That is, FIG. 5 shows substantially circular roll flange parts f3, f4 disposed so as to sandwich both width-direction sides of the separation material layer 151, and conveniently denotes the location where the third roll R3 is formed using the reference number "R3."

Tape Roll with Print and Surrounding Area Thereof

On the other hand, as shown in FIG. 2 and FIG. 4, a take-up mechanism 40 comprising a winding core 41 for sequentially winding the above described tape 150" with print is received in the above described third storage part 4 from above. The take-up mechanism 40 is stored so that the above described winding core 41 is supported rotatably around an axis O2 of the winding of the tape 150" with print, with the axis O2 in the left-right direction. Then, with the take-up mechanism 40 stored in the third storage part 4, the winding core 41 is driven by an adhesive take-up motor M2 that is disposed in the interior of the housing main body 2*a* via a gear mechanism (not shown) and rotates in a predetermined rotating direction (a direction B in FIG. 2) inside the third storage part 4, sequentially taking up and layering the tape 150" with print on the outer circumference side of the winding core 41. With this arrangement, the tape 150" with print is sequentially wound around the outer circumference side of the winding core 41, forming a second roll R2.

Cutter Mechanism

Further, as shown in FIG. 2, a cutter mechanism 30 is disposed on the downstream side of the printing head 11 and the upstream side of the second roll R2, along the tape transport direction.

The cutter mechanism 30, while not shown in detail, comprises a movable blade and a carriage that supports the movable blade and is capable of travelling in the tape width direction (in other words, the left-right direction). Then, the carriage travels by the driving of a cutter motor MC (refer to FIG. 6 described later) and the movable blade moves in the tape width direction, cutting the above described tape 150" with print in the width direction.

Overview of Operation of Tape Printer

Next, an overview of the operation of the tape printer 1 with the above described configuration will be described.

That is, when the tape cartridge TK is mounted in the above described first predetermined position 13, the first roll R1 is stored in the first storage part 3 positioned on the rearward side of the housing main body 2*a*, and the axis O3 side that forms the third roll R3 is stored in the second storage part 5 positioned on the frontward side of the housing main body 2*a*. Further, the take-up mechanism 40 for forming the second roll R2 is stored in the third storage part 4 positioned on the frontward side of the housing main body 2*a*.

In this state, the user manually peels the separation material layer 151 from the print-receiving tape 150 (on which printing has not started at this point in time), and attaches a tip end of a tape 150-1 (conveniently referred to in this manner; refer to FIG. 9B described later) made of the base layer 153 and the adhesive layer 152 to the winding core 41 of the above described take-up mechanism 40. Then, when the feeding roller 12 is driven, the print-receiving tape 150 fed out by the rotation of the first roll R1 stored in the first storage part 3 is fed to the frontward side. Then, desired print is formed by the printing head 11 on the print-receiving layer 154 of the print-receiving tape 150 thus fed, thereby forming the tape 150' with print. When the tape 150' with print on which print was formed is further fed to the frontward side and fed to the peeling part 17, the separation material layer 151 is peeled at the peeling part 17, forming the tape 150" with print. The peeled separation material layer 151 is fed to the downward side, introduced to and wound inside the second storage part 5, forming the third roll R3.

On the other hand, the tape 150" with print from which the separation material layer 151 has been peeled is further fed to the frontward side, introduced to the third storage part 4, and wound around the outer circumference side of the winding core 41 of the take-up mechanism 40 inside the third storage part 4, thereby forming the second roll R2. At this time, the cutter mechanism 30 disposed on the transport direction downstream side (that is, the frontward side) cuts the tape 150" with print. With this arrangement, the tape 150" with print wound around the second roll R2 can be cut based on a timing desired by the user and the second roll R2 can be removed from the third storage part 4 after cutting. Note that the tape 150" with print (that forms the second roll R2) wound into a roll shape around the outer circumference part of the winding core 41 in this manner is suitably simply referred to as a "printed matter."

Note that, at this time, although not explained by illustration, a non-adhesive tape (without the above described adhesive layer 152 and separation material layer 151) may be wound around the first roll R1. In this case as well, the first roll R1 which winds the non-adhesive tape is received in the first storage part 3 from above by the mounting of the tape cartridge TK and stored with the axis O1 of the winding of the non-adhesive tape in the left-right direction. Then, the first roll R1, stored in the first storage part 3 (with the tape cartridge TK mounted), rotates in a predetermined rotating direction (the direction A in FIG. 2) inside the first storage part 3, thereby feeding out the non-adhesive tape.

Further, at this time, a shoot 15 (refer to FIG. 2) for switching the feeding path of the above described non-adhesive tape (or the above described print-receiving tape 150) between a side toward the second roll R2 and a side toward the discharging exit (not shown) may be disposed. That is, the non-adhesive tape after print formation (or the tape 150" with print) may be discharged as is from the discharging exit (not shown) disposed on the second opening/closing cover 8*b* side, for example, of the housing 2 to the outside of the housing 2 without being wound inside the third storage part 4 as described above by switching the tape path by a switch operation of the shoot 15 using a switch lever (not shown).

Control System

Figure 6:
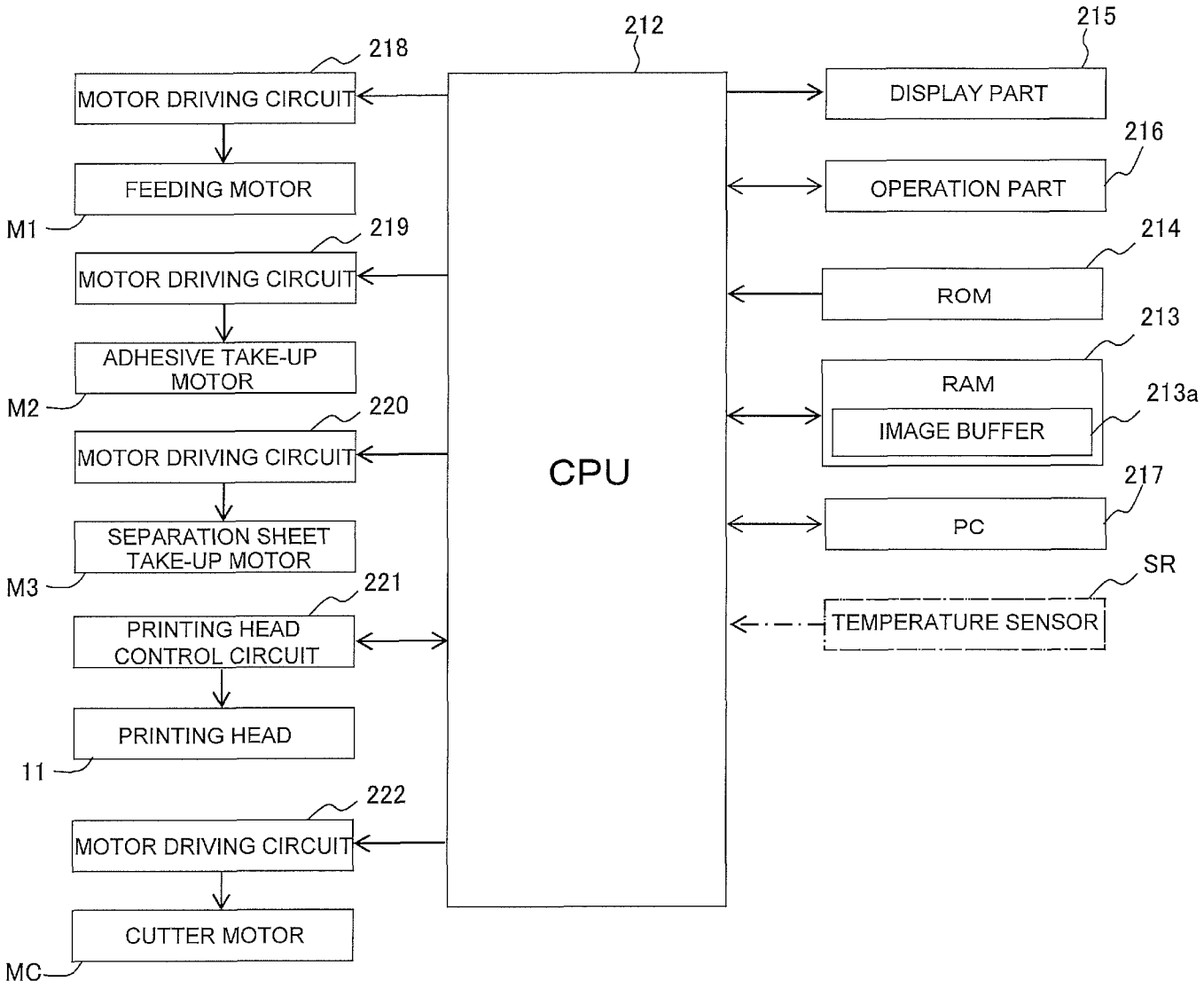
FIG. 6 is a function block diagram showing the configuration of the control system of the tape printer.

Next, the control system of the tape printer 1 will be described using FIG. 6. In FIG. 6, the tape printer 1 comprises a CPU 212 that constitutes a computing part that performs predetermined computations. The CPU 212 is connected to a RAM 213 and a ROM 214. The CPU 212 performs signal processing in accordance with a program stored in advance in the ROM 214 while utilizing a temporary storage function of the RAM 213, and controls the entire tape printer 1 accordingly.

Further, the CPU 212 is connected to a motor driving circuit 218 that controls the driving of the above described feeding motor M1 that drives the above described feeding roller 12, a motor driving circuit 219 that controls the driving of the above described adhesive take-up motor M2 that drives the winding core 41 of the above described take-up mechanism 40, a motor driving circuit 220 that controls the driving of the above described separation sheet take-up motor M3 that drives the above described third roll R3, a printing head control circuit 221 that controls the current conduction of the heating elements (not shown) of the above described printing head 11, a motor driving circuit 222 that controls the driving of the cutter motor MC that causes the carriage comprising the above described movable blade to travel, a display part 215 that performs suitable displays, and an operation part 216 that permits suitable operation input by the user. Further, while the CPU 212 is connected to the PC 217 serving as an external terminal in this example, the CPU 212 does not need to be connected in a case where the tape printer 1 operates alone (since it is a so-called stand-alone type). Note that a temperature sensor SR will be described later.

The ROM 214 stores control programs for executing predetermined control processing (including programs that execute the flow processing in FIG. 12 and FIG. 13 described later). The RAM 213 comprises an image buffer 213*a* that expands print data (refer to step S204 described later) generated in correspondence with an operation of the above described operation part 216 (or the above described PC 217) by the user into dot pattern data for printing in a predetermined area of the above described print-receiving layer 154, and stores the data, for example. The CPU 212 repeatedly prints one image corresponding to the above described dot pattern data stored in the image buffer 213*a* on the print-receiving tape 150 by the printing head 11 while feeding out the print-receiving tape 150 by the feeding roller 12, based on the above described control programs.

Special Characteristic of the Embodiment

In the above, the special characteristic of this embodiment lies in the suppression of the occurrence of faint print immediately after the start of printing when the above described printed matter is generated by the adhesive tape 150" with print as described above. In the following, details on the functions will be described in order.

Comparison Example

In general, in a case where print formation is performed by the printing head 11 as described above, the heating elements included in the printing head 11 may not be sufficiently warmed up immediately after the start of printing, resulting in a decrease in print quality, such as the occurrence of faint print and the like.

Hence, in a case where the above described printed matter is produced by take-up of the tape 150" with print as in the above described tape printer 1, a tip end region P1 (the area connected to the winding core 41 on the tip end side of a print area P2 described later) of the tape 150-1 is attached to the above described winding core 41 (refer to FIG. 7A and FIG. 7B) and then print formation is started as described above. At this time, when print is formed in the print area P2 (the area where desired print is formed) with the printing head 11 not yet sufficiently warmed up, the above described faint print may occur in a section of the print contents (the characters "UENO-TECH" repeatedly printed in this example; refer to FIG. 7C). In a case where the printed matter is produced by take-up of the tape 150" with print as in this tape printer 1 and the above described faint print is found after production of the above described printed matter (in other words, generation of the second roll R2), the above described printed matter produced by take-up becomes an entirely defective product, resulting in waste.

Overview of Technique of Embodiment

Hence, to avoid the above, in this embodiment, the print part HR for preheating is formed in the border area (refer to the broken line) between the above described print area P2 and the above described tip end region P1 of the tape 150-0. With this arrangement, the printing head 11 forms the print part HR for preheating in the above described border area prior to formation of desired print in the print area P2 as described above, making it possible to execute print formation in the above described print area P2 in a sufficiently warmed up state due to the formation operation, and perform favorable printing without faint print (refer to FIG. 7D).

Practical Use of the Tip End Region

Figure 8A:
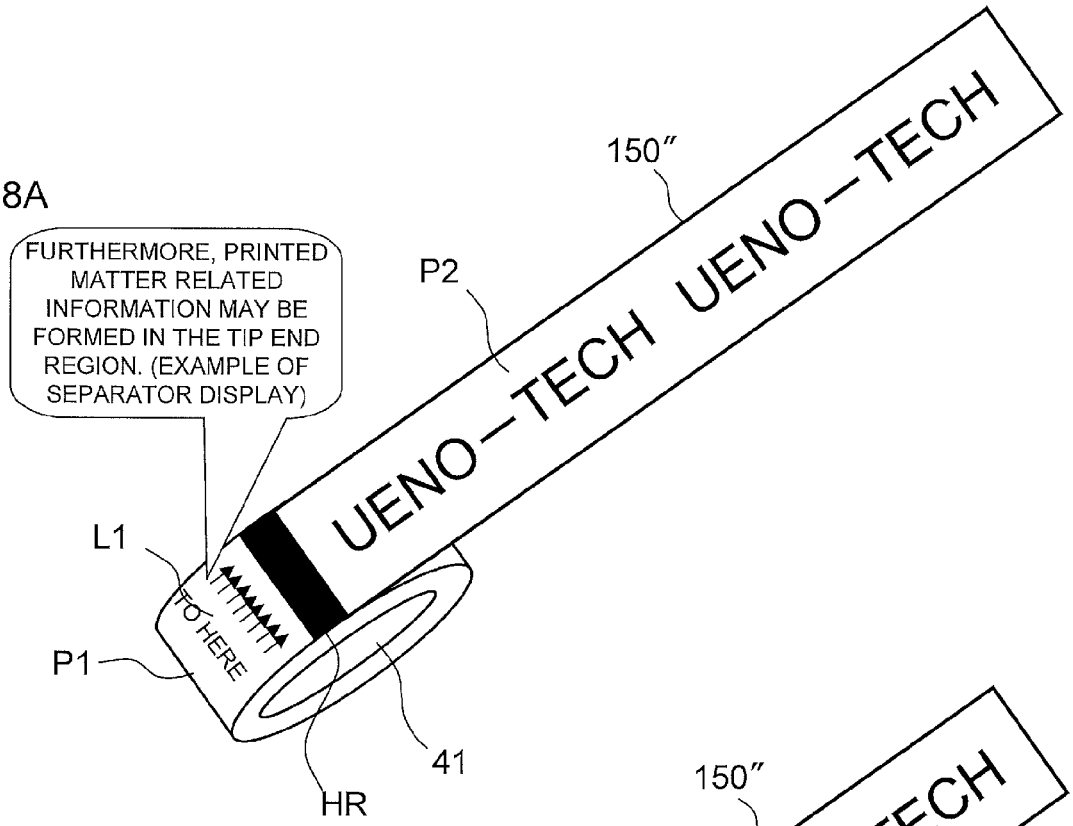
FIG. 8A is an explanatory view showing printed matter related information formed in the tip end region.
Figure 8B:
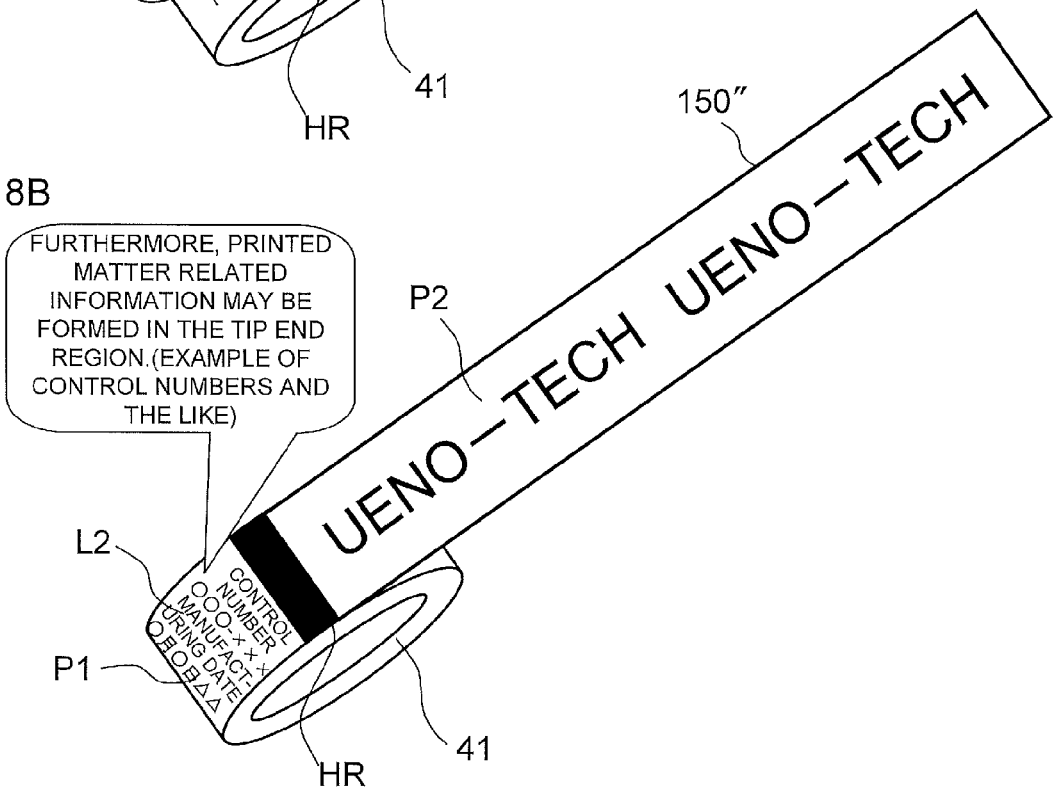
FIG. 8B is an explanatory view showing printed matter related information formed in the tip end region.

Further, in particular, in this embodiment, in addition to the above described technique, the tip end region P1 separated from the print area P2 via the above described print part HR for preheating is effectively utilized as a suitable information display area, as shown in FIG. 8A and FIG. 8B. That is, in the example shown in FIG. 8A, the "↑↑↑↑ To Here" notation characters L1, which serve as a separator display between the above described print area P2 and the tip end region P1 (in other words, a display indicating the area serving as the product) is printed in the tip end region P1 as the printed matter related information in relation to the generated above described printed matter.

In the example shown in FIG. 8B, the notation characters L2, such as a control number, manufacturing date, and the like, are printed in the tip end region P1 as printed matter related information in relation to the generated above described printed matter.

Tape Feeding and Take-Up Behavior

Next, the tape feeding and take-up behavior in this embodiment, including formation of the above described print part HR for preheating, will be described using FIGS. 9-11.

Preparation Processing

Figure 9A:
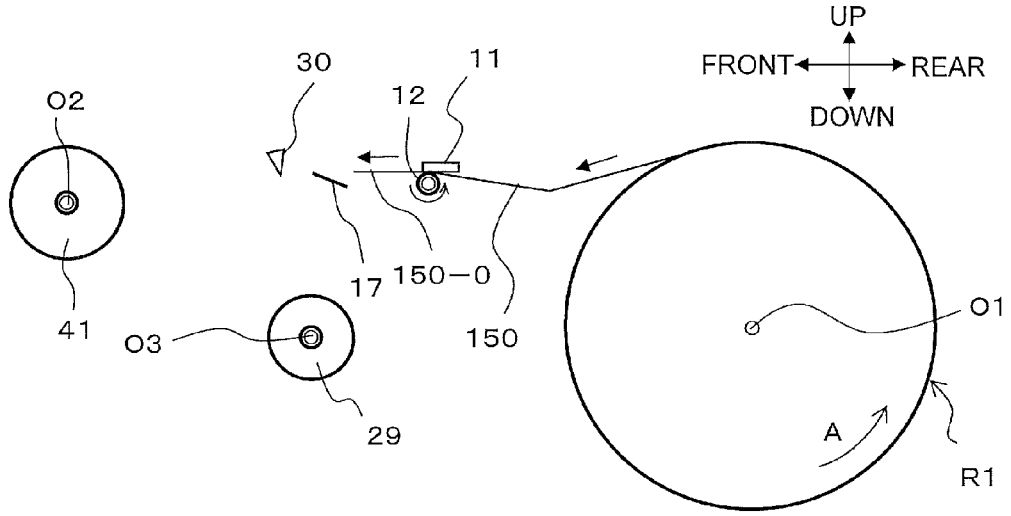
FIG. 9A is an explanatory view showing the tape feeding, take-up behavior, and the like in preparation processing.
Figure 9B:
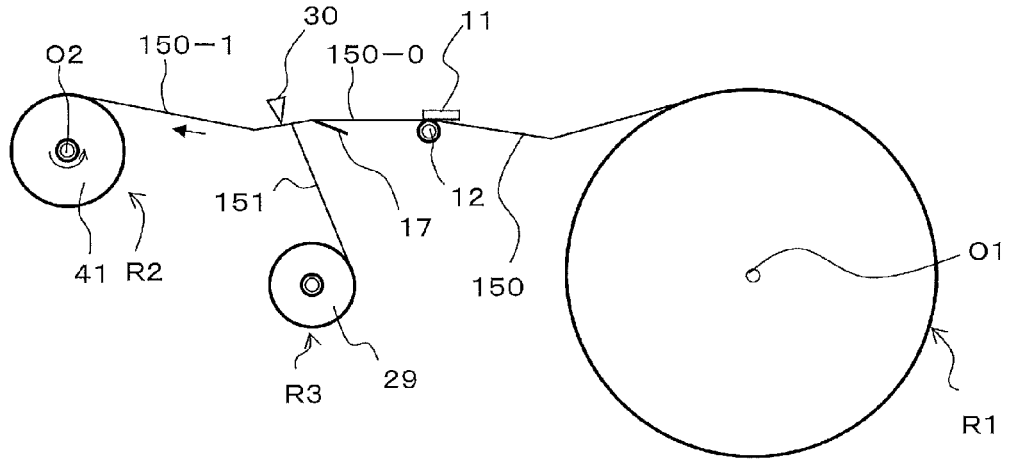
FIG. 9B is an explanatory view showing the tape feeding, take-up behavior, and the like in preparation processing.
Figure 9C:
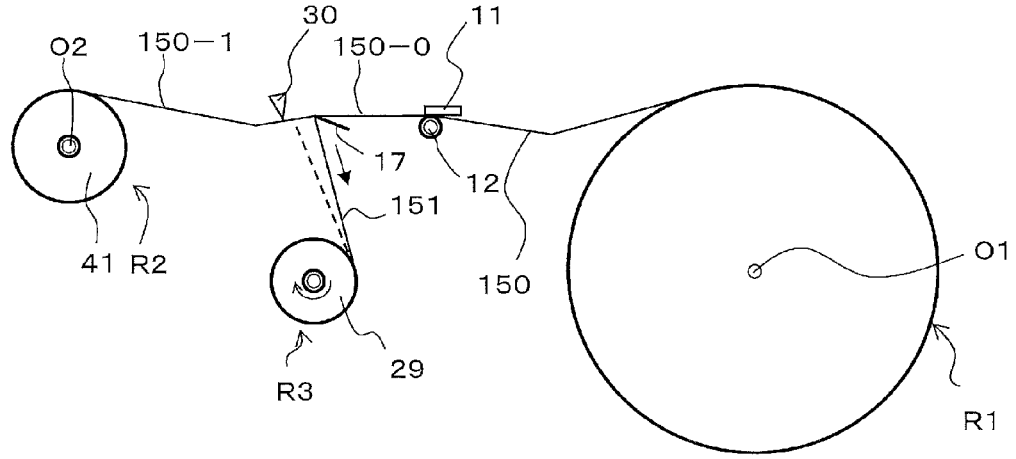
FIG. 9C is an explanatory view showing the tape feeding, take-up behavior, and the like in preparation processing.

First, according to this embodiment, before print is formed by the printing head 11 such as described above, predetermined preparation processing for removing the slack of the print-receiving tape 150 is performed. FIGS. 9A-9C schematically show this preparation processing step.

First, the user manually feeds out the print-receiving tape 150 from the first roll R1 of the tape cartridge TK as described above, and passes the fed out print-receiving tape 150 between the feeding roller 12 and the printing head 11 (refer to FIG. 9A). At this time, the CPU 212 controls the feeding motor M1 for a predetermined period of time so that the feeding roller 12 is rotated in the transport direction. Note that the print-receiving tape 150 passed between the feeding roller 12 and the printing head 11 and advanced to the downstream side thereof in this manner is referred to as the aforementioned tape 150-0 for convenience of explanation. This tape 150-0 is an area corresponding to the tape 150' with print after the start of print formation by the printing head 11.

Subsequently, the user manually peels the separation material layer 151 from the above described tape 150-0, and secures the tip end (that is, the above described tip end region P1) of the tape 150-1 made of the base layer 153 and the adhesive layer 152 to the winding core 41 of the take-up mechanism 40 for forming the second roll R2. With the above described securement, the above described printed matter is produced (in other words, the second roll R2 is generated) by the winding of the tape 150-1 and the above described tape 150" with print with the rotation of the winding core 41 thereafter. On the other hand, the user secures the tip end of the separation material layer 151 peeled from the tape 150-0 to a winding core 29 (refer to the above described FIG. 5) for forming the third roll R3 (refer to FIG. 9B). With this arrangement, the above described third roll R3 is formed by the winding of the separation material layer 151 with the rotation of the winding core 29 thereafter.

In this state, the CPU 212 stops the feeding roller 12 for a predetermined period of time and controls the feeding motor M1 and the adhesive take-up motor M2 so that only the above described winding core 41 is rotated in the take-up direction (refer to FIG. 9B). With this arrangement, the above described tape 150-1 from which the separation material layer 151 was peeled is pulled by the stopped feeding roller 12 and the winding core 41 that rotates in the take-up direction and, at the moment that the slack is removed, the rotation of the winding core 41 stops, causing tension to be applied to the tape 150-1. Note that, if rotation of the winding core 41 is detected at the moment that tension is to be applied to the tape 150-1 in this manner, the winding core 41 (in other words, the second roll R2) is regarded as rotating idly since the tip end of the tape 150-1 is not well secured to the winding core 41, and a defect is reported (refer to step S135 and step S190 described later).

Next, the CPU 212 stops the feeding roller 12 for a predetermined period of time and controls the feeding motor M1 and the separation sheet take-up motor M3 so that only the above described winding core 29 is rotated in the take-up direction (refer to FIG. 9C). With this arrangement, the separation material layer 151 peeled from the tape 150-0 is pulled by the stopped feeding roller 12 and the winding core 29 (in other words, the third roll R3) that rotates in the take-up direction and, at the moment that the slack is removed, the rotation of the winding core 29 stops, causing tension to be applied to the tape 150-0. Further, at this time, even if the separation point between the tape 150-0 and the separation material layer 151 has moved by the retraction of the tape 150-0 due to the rotation of the above described second roll R2 only, the point can be returned to its original position (refer to the broken line in FIG. 9C). Note that, if rotation of the third roll R3 is detected at the moment that tension is to be applied to the separation material layer 151 in this manner, the third roll R3 is regarded as rotating idly since the tip end of the separation material layer 151 is not well secured to the above described winding core 29, and a defect is reported (refer to step S155 and step S198 described later).

Next, the CPU 212 controls the feeding motor M1, the adhesive take-up motor M2, and the separation sheet take-up motor M3 for a predetermined period of time so as to rotate the feeding roller 12, the second roll R2, as well as the third roll R3 (without performing a print operation; not particularly shown). With this final verification operation, it is possible to verify in advance whether or not the series of operations including the feed-out and feeding of the print-receiving tape 150, the feeding of the tape 150-0, the feeding and take-up of the tape 150-1, the peeling and take-up of the separation material layer 151, and the like are normally performed.

Print Formation

Figure 10A:
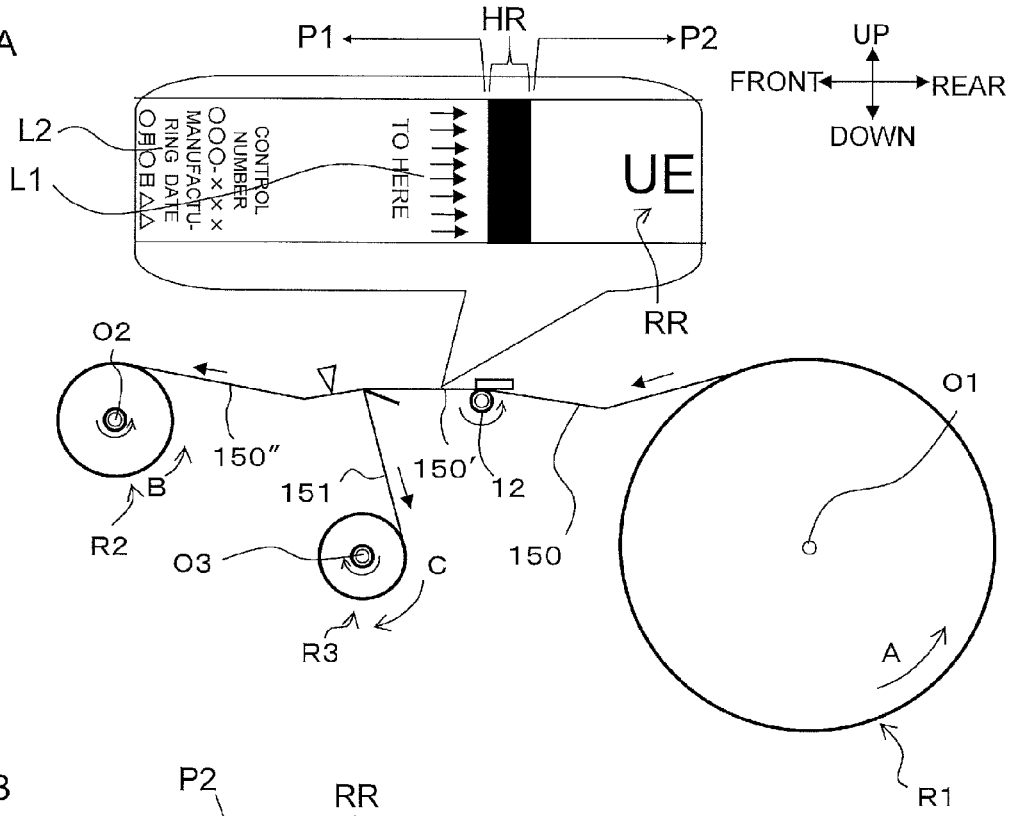
FIG. 10A is an explanatory view showing the tape feeding, print formation, tape take-up behavior, and the like during printed matter generation.

After completion of the above described preparation processing, feed-out and feeding of the print-receiving tape 150 and print formation by the printing head 11 are started. First, as shown in FIG. 10A, the printed matter related information is formed in the above described tip end region P1 by the printing head 11. In this example, first, after formation of the notation characters L2, such as the above described control number and the like, is performed on the transport direction downstream side of the tip end region P1, the "nit To Here" notation characters L1 of the above described separator display are subsequently formed on the transport direction upstream side of the tip end region P1. Furthermore, the print part HR for preheating (the solid black region that comprises a predetermined dimension in the transport direction and extends in the tape width direction in this example) is formed in the border area between the above described tip end region P1 and print area P2. Further, formation of desired print RR (the characters "UENO-TECH" in this example) intended by the user is started in the print area P2 on the transport direction upstream side of the above described print part HR for preheating.

As described above, the above described feed-out and feeding of the print-receiving tape 150, the generation and feeding of the tape 150' with print resulting from formation of the above described notation characters L1, L2, the print part HR for preheating, and the print RR on the print-receiving tape 150, the generation of the tape 150" with print resulting from the peeling of the separation material layer 151 from the tape 150' with print and the take-up of the peeled separation material layer 151, and the feeding and take-up of the tape 150" with print are started.

Figure 10B:
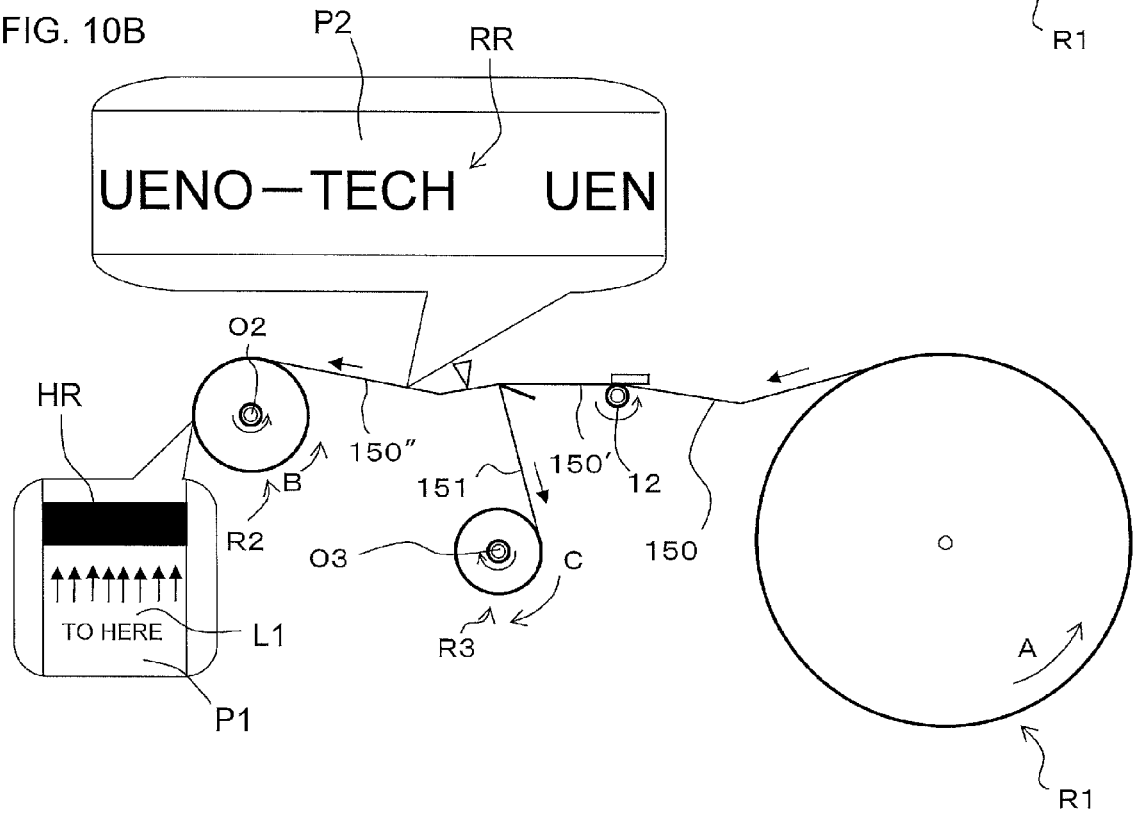
FIG. 10B is an explanatory view showing the tape feeding, print formation, tape take-up behavior, and the like during printed matter generation.

Subsequently, as shown in FIG. 10B, as the feeding of the above described print-receiving tape 150, tape 150' with print, and tape 150" with print continues, formation of the print RR in the above described print area P2 is repeatedly executed in the tape longitudinal direction (transport direction) while the formed above described notation characters L1, L2 and print part HR for preheating proceed to the transport direction downstream side. Further, as a result, the tape 150" with print resulting from the peeling of the separation material layer 151 from the tape 150' with print is sequentially taken up around the axis O2 by the take-up mechanism 40 (refer to FIG. 11A).

Figure 11A:
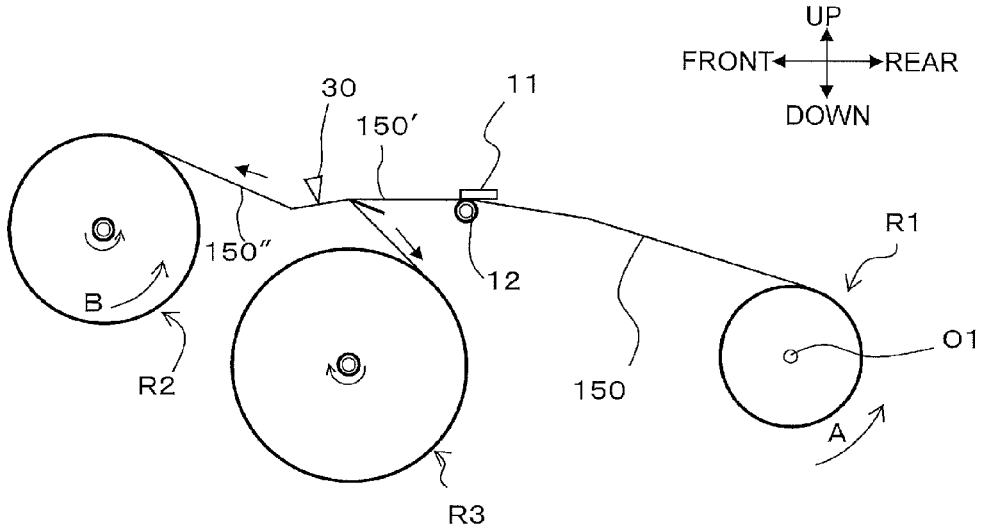
FIG. 11A is an explanatory view showing the tape feeding, cutting, take-up behavior, and the like during printed matter production.
Figure 11B:
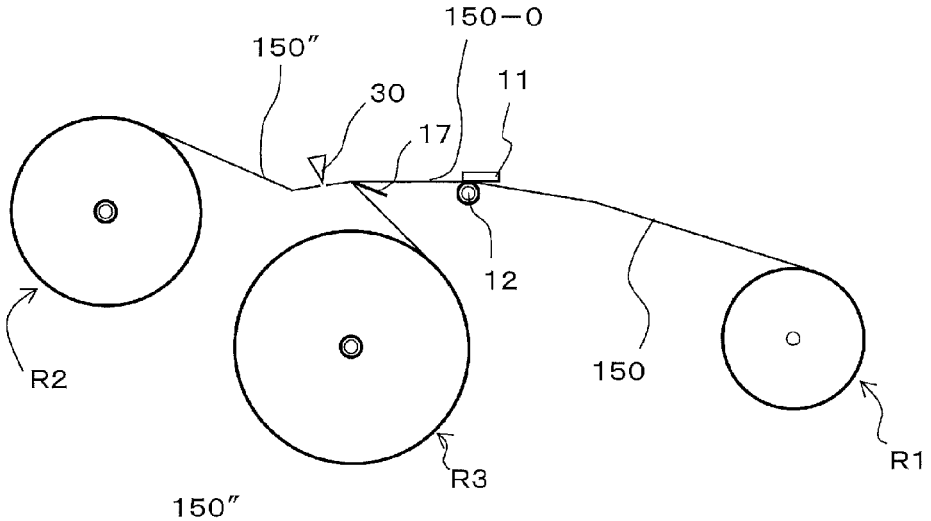
FIG. 11B is an explanatory view showing the tape feeding, cutting, take-up behavior, and the like during printed matter production.

Subsequently, the formation operation of the second roll R2 advances further from the state shown in the above described FIG. 11A and, once the print-receiving tape 150, the tape 150' with print, and the tape 150" with print are in a specific transport direction position corresponding to the intention of the user, the rotation of the feeding roller 12, the second roll R2, as well as the third roll R3 is stopped as shown in FIG. 11B. As a result, the feed-out and feeding of the above described print-receiving tape 150, the feeding of the tape 150' with print, and the feeding and take-up of the tape 150"

with print are stopped. Note that print formation is stopped in advance of the above described stop so that the area between the cutter mechanism 30 and the printing head 11 becomes the above described tape 150-0, which is a non-print section, in this stopped state. In this state, the cutter mechanism 30 cuts the tape 150" with print between the feeding roller 12 and the second roll R2 (refer to FIG. 11B).

Subsequently, the adhesive take-up motor M2 is controlled so that the second roll R2 stops after rotation for a predetermined amount of time in the take-up direction (with the feeding roller 12 stopped as is). That is, after completion of the cutting of the tape 150" with print by the cutter mechanism 30, the second roll R2 does not stop immediately, but rather after rotation for a predetermined amount of time. With this arrangement, the second roll R2 is rotated a predetermined amount after cutting completion, and the end edge of the tape 150" with print generated by cutting is reliably taken up on the second roll R2, completing production of the above described printed matter (refer to FIG. 11C).

Control Flow

Figure 12:
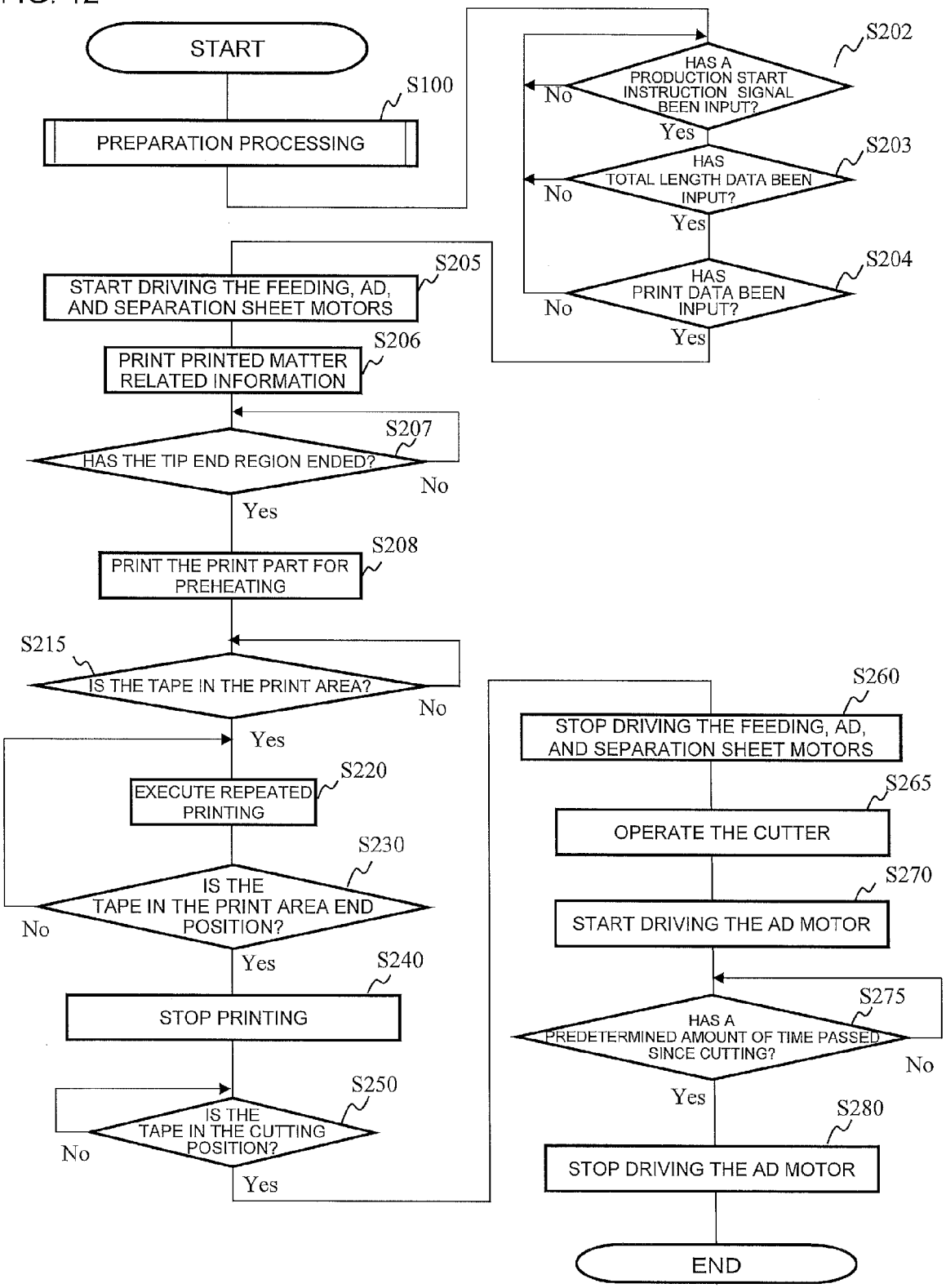
FIG. 12 is a flowchart showing the control procedure executed by the CPU.
Figure 13:
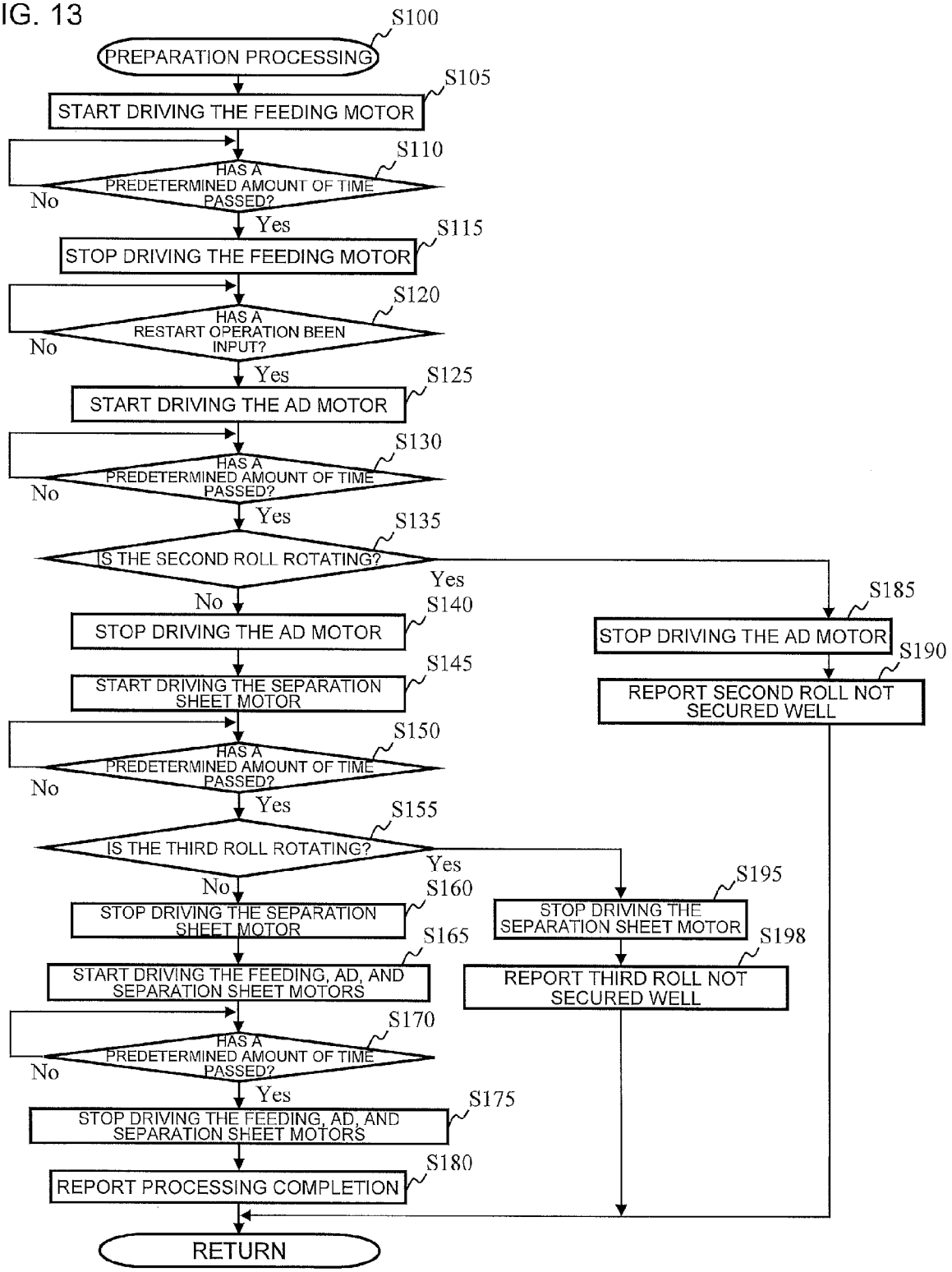
FIG. 13 is a flowchart showing the detailed procedure in step S100.

The following describes the processing content executed by the CPU 212 to achieve the above described technique, using the flow in FIG. 12 and FIG. 13. Note that, in FIG. 12 and FIG. 13, the name of each component is shown suitably abbreviated (hereinafter the same).

In FIG. 13, the flow is started ("START" position) by the user turning ON the power of the tape printer 1, for example.

First, in step S100, the CPU 212 executes the above described preparation processing. FIG. 13 shows the detailed content of this preparation processing.

Details of Preparation Processing

In FIG. 13, first, in step S105, the CPU 212 outputs a control signal to the motor driving circuit 218, and starts the driving of the feeding motor M1.

Subsequently, in step S110, the CPU 212 determines whether or not a predetermined amount of time has passed since the driving of the feeding motor M1 was started in the above described step S105. If the predetermined amount of time has not passed, the condition of step S110 is not satisfied (step S110: NO), and the flow loops back and enters a standby state until the predetermined amount of time passes. In this case, the predetermined amount of time that the flow is in a standby state may be about the amount of time it takes for the above described tape 150-0 positioned on the tip end side of the print-receiving tape 150 fed out from the first roll R1 to be fed from the feeding roller 12 and arrive at the second roll R2 or the third roll R3. If the predetermined amount of time has passed, the condition of step S110 is satisfied (step S110: YES), and the flow proceeds to step S115.

In step S115, the CPU 212 outputs a control signal to the motor driving circuit 218 and stops the driving of the feeding motor M1.

Subsequently, in step S120, the CPU 212 determines whether or not (attachment of the aforementioned tip end region P1 to the above described winding core 41, and attachment of the separation material layer 151 associated thereto to the above described winding core 29 have been completed, and) an operation that instructs operation restart has been input by the user via the operation part 216 (or the above described PC 217). If the above described instruction operation has not been input, the condition of step S120 is not satisfied (step S120: NO), and the flow loops back and enters a standby state until the instruction operation is input. If the above described instruction operation has been input, the condition of step S120 is satisfied (step S120: YES), and the flow proceeds to step S125.

In step S125, the CPU 212 outputs a control signal to the motor driving circuit 219, and starts the driving of the adhesive take-up motor M2 (abbreviated as "AD motor" in the figure; refer to the above described FIG. 9B).

Subsequently, in step S130, the CPU 212 determines whether or not a predetermined amount of time has passed since the driving of the adhesive take-up motor M2 was started in the above described step S125. If the predetermined amount of time has not passed, the condition of step S130 is not satisfied (step S130: NO), and the flow loops back and enters a standby state until the predetermined amount of time passes. In this case, the predetermined amount of time that the flow is in a standby state may be about the amount of time it takes for the slack of the above described tapes 150-0, 150-1 from the feeding roller 12 to the second roll R2 to be removed and appropriate tension to be applied (1 s maximum, for example). If the predetermined amount of time has passed, the condition of step S130 is satisfied (step S130: YES), and the flow proceeds to step S135.

In step S135, the CPU 212 determines whether or not the second roll R2 is rotating at this moment based on a detection result of a suitable rotation detection sensor (such as an optical sensor, for example; not shown) disposed in accordance with the second roll R2. If the second roll R2 is not rotating, the condition is not satisfied (S135: NO), and the flow proceeds to step S140.

In step S140, the CPU 212 outputs a control signal to the motor driving circuit 219 and stops the driving of the adhesive take-up motor M2.

Subsequently, in step S145, the CPU 212 outputs a control signal to the motor driving circuit 220, and starts the driving of the separation sheet take-up motor M3 (abbreviated as "separation sheet motor" in the figure; refer to the above described FIG. 9C).

Then, in step S150, the CPU 212 determines whether or not a predetermined amount of time has passed since the start of the driving of the separation sheet take-up motor M3 in the above described step S145. If the predetermined amount of time has not passed, the condition of step S150 is not satisfied (step S150: NO), and the flow loops back and enters a standby state until the predetermined amount of time passes. In this case, the predetermined amount of time that the flow is in a standby state may be about the amount of time it takes for the slack of the separation material layer 151 from the feeding roller 12 to the third roll R3, including the pull-back of the aforementioned separation point, to be removed and appropriate tension to be applied. If the predetermined amount of time has passed, the condition of step S150 is satisfied (step S150: YES), and the flow proceeds to step S155.

In step S155, the CPU 212 determines whether or not the third roll R3 is rotating at this moment based on a detection result of a suitable rotation detection sensor (such as an optical sensor, for example; not shown) disposed in accordance with the third roll R3. If the third roll R3 is not rotating, the condition is not satisfied (S155: NO), and the flow proceeds to step S160.

In step S160, the CPU 212 outputs a control signal to the motor driving circuit 220 and stops the driving of the separation sheet take-up motor M3.

Subsequently, in step S165, the CPU 212 outputs a control signal to the motor driving circuits 218, 219, 220, and starts the driving of the feeding motor M1, the adhesive take-up motor M2, and the separation sheet take-up motor M3.

Then, in step S170, the CPU 212 determines whether or not a predetermined amount of time has passed since the start of the driving of each motor in the above described step S165. If the predetermined amount of time has not passed, the condition of step S170 is not satisfied (step S170: NO), and the flow loops back and enters a standby state until the predetermined amount of time passes. In this case, the predetermined amount of time that the flow is in a standby state may be about the amount of time that it takes to adequately visually verify whether or not the series of operations including the feed-out and feeding of the print-receiving tape 150, the feeding of the tape 150-0, the feeding and take-up of the tape 150-1, the take-up of the separation material layer 151, and the like is normally performed. If the predetermined amount of time has passed, the condition of step S170 is satisfied (step S170: YES), and the flow proceeds to step S175.

In step S175, the CPU 212 outputs a control signal to the motor driving circuits 218, 219, 220, and stops the driving of the feeding motor M1, the adhesive take-up motor M2, and the separation sheet take-up motor M3.

Subsequently, in step S190, the CPU 212 regards the second roll R2 as rotating idly since the tip end of the tape 150-1 is not well secured to the winding core 41 for the second roll R2, and informs the user by displaying so or the like on the display part 215 (or the PC 217). This flow then terminates here.

On the one hand, if the CPU 212 determines that the second roll R2 had been rotating in the above described step S135, the condition is satisfied (S135: YES), and the flow proceeds to step S185.

In step S185, the CPU 212 outputs a control signal to the motor driving circuit 219 and stops the driving of the adhesive take-up motor M2.

Subsequently, in step S190, the CPU 212 regards the second roll R2 as rotating idly since the above described tip end region P1 of the tape 150-1 is not well secured to the winding core 41 for the second roll R2, and informs the user by displaying so or the like on the display part 215 (or the PC 217). This flow then terminates here.

Further, on the other hand, if the CPU 212 determines that the third roll R3 had been rotating in the above described step S155, the condition is satisfied (S155: YES), and the flow proceeds to step S195.

In step S195, the CPU 212 outputs a control signal to the motor driving circuit 220 and stops the driving of the separation sheet take-up motor M3.

Subsequently, in step S198, the CPU 212 regards the third roll R3 as rotating idly since the tip end of the separation material layer 151 is not well secured to the aforementioned winding core 29, and informs the user by displaying so or the like on the display part 215. This flow then terminates here.

Processing after Preparation Processing Completion

Returning to FIG. 12, once the preparation processing in the above described step S100 has been completed, the flow proceeds to step S202. In step S202, the CPU 212 determines whether or not a production start instruction signal corresponding to a production start operation for the above described printed matter performed by the user using the operation part 216 (or the above described PC 217) has been input. If the above described production start instruction signal has not been input, the condition of step S202 is not satisfied (S202: NO), and the flow loops back and enters a standby state. If the above described production start instruction signal has been input, the condition of step S202 is satisfied (S202: YES), and the flow proceeds to step S203.

In step S203, the CPU 212 determines whether or not the total length data indicating the tape length of the above described printed matter to be produced (in other words, the overall length of the print area P2 of the above described tape 150" with print to be generated, excluding the length of the above described tip end region P1 of the total length along the transport direction) has been input in accordance with an operation by the user using the operation part 216 (or the above described PC 217). If the above described total length data corresponding to the length intended by the user has not been input, the condition of step S203 is not satisfied (S203: NO), the flow returns to the above described step S202, and the same procedure is repeated. If the above described total length data has been input, the condition of step S203 is satisfied (S203: YES), and the flow proceeds to step S204.

In step S204, the CPU 212 determines whether or not print data (the text data "UENO-TECH" corresponding to the print RR in the aforementioned example) indicating one image desired by the user, to be formed into print in the above described print area P2 of the above described print-receiving tape 150 (repeatedly formed into print in the tape longitudinal direction in this example), has been input in accordance with an operation by the user using the operation part 216 (or the above described PC 217). If the print data has not been input, the condition of step S204 is not satisfied (S204: NO), the flow returns to the above described step S202, and the same procedure is repeated. If the above described print data has been input, the condition of step S204 is satisfied (S204: YES), and the flow proceeds to step S205. Note that, in this step S204, the contents of the above described printed matter related information formed into print in the above described tip end region P1 may be input by the user.

Subsequently, in step S205, the CPU 212 outputs a control signal to the motor driving circuits 218, 219, 220, and starts the driving of the feeding motor M1, the adhesive take-up motor M2, and the separation sheet take-up motor M3. With this arrangement, the feeding of the above described print-receiving tape 150, the tape 150' with print, and the tape 150" with print (hereinafter suitably simply referred to as "tape feeding"), and the take-up of the above described tape 150" with print is started.

Then, the flow proceeds to step S206 where the CPU 212 outputs a control signal to the printing head control circuit 221, conducts current to the heating elements of the printing head 11, and forms the aforementioned printed matter related information (the notation characters L1, L2, and the like in the above described example) in the above described tip end region P1 (refer to the above described FIG. 10A).

Subsequently, the flow proceeds to step S207 where the CPU 212 determines whether or not the above described tape feeding has arrived where the printing head 11 faces an end position of the tip end region P1 (transport direction upstream side end of the tip end region P1) by the above described tape feeding started in the above described step S205, by a known technique. If the feeding has not arrived at the end position of the above described tip end region P1, the condition of step S207 is not satisfied (S207: NO) and the flow loops back and enters a standby state until this condition is satisfied. If the feeding has arrived at the above described end position of the tip end region P1, the condition of step S207 is satisfied (S207: YES), and the flow proceeds to step S208.

In step S208, the CPU 212 outputs a control signal to the printing head control circuit 221, conducts current to the heating elements of the printing head 11, and forms the print part HR for preheating (the above described solid black region in the aforementioned example) in the border area between the above described print area P2 and the above described tip end region P1. With this arrangement, the printing head 11 forms the print part HR for preheating, thereby causing the heating elements to be sufficiently warmed up, making subsequent print formation without faint print in the above described print area P2 possible.

Subsequently, in step S215, the CPU 212 determines whether or not the above described tape feeding has arrived where the printing head 11 faces the print start position (transport direction downstream side end) of the print area P2 by a known technique, based on the print data acquired in the above described step S204. If the feeding has not arrived at the print start position, the condition is not satisfied (S215: NO), and the flow loops back and enters a standby state. If the feeding has arrived at the print start position, the condition of step S215 is satisfied (S215: YES), and the flow proceeds to step S220.

In step S220, the CPU 212 outputs a control signal to the printing head control circuit 221, conducts current to the heating elements of the printing head 11, and starts repeated print formation (repeated formation of the same above described print RR) of one image corresponding to the print data input in the above described step S204 in the above described print area P2.

Subsequently, in step S230, the CPU 212 determines whether or not the above described tape feeding has arrived where the printing head 11 faces the end position of the print area P2 (transport direction upstream side end) by a known technique, based on the print data acquired in the above described step S204. If the feeding has not arrived at the print end position, the condition is not satisfied (S230: NO), the flow returns to the above described step S220, and the same procedure is repeated. If the feeding has arrived at the print end position, the condition is satisfied (S230: YES), and the flow proceeds to step S240.

In step S240, the CPU 212 outputs a control signal to the printing head control circuit 221, and stops conducting current to the heating elements of the printing head 11 and print formation (formation of the print RR) in the above described print area P2. At this time, the tape feeding is continually performed. With this arrangement, the tape 150' with print thereafter becomes blank where the print part 155 does not exist (the aforementioned tape 150-0). Subsequently, the flow proceeds to step S250.

In step S250, the CPU 212 determines whether or not the above described tape feeding has arrived at the cutting position by the above described cutter mechanism 30 (a cutting position such as where the total length along the transport direction of the above described print area P2 of the tape 150" with print wound as the second roll R2 by the take-up mechanism 40 becomes the length intended by the user), in accordance with the total length data acquired in the above described step S203. If the feeding has not arrived at the cutting position, the condition is not satisfied (S250: NO), and the flow loops back and enters a standby state. If the feeding has arrived at the cutting position, the condition is satisfied (S250: YES), and the flow proceeds to step S260.

In step S260, the CPU 212 outputs a control signal to the motor driving circuits 218, 219, 220, and stops the driving of the feeding motor M1, the adhesive take-up motor M2, and the separation sheet take-up motor M3. With this arrangement, the feeding of the above described print-receiving tape 150, the tape 150' with print, and the tape 150" with print (including the above described tape 150-0 as well) is stopped.

Subsequently, in step S265, the CPU 212 outputs a control signal to the motor driving circuit 222, drives the above described cutter motor MC, and cuts the tape 150" with print by the operation of the above described cutter mechanism 30 (refer to FIG. 11B).

Figure 11C:
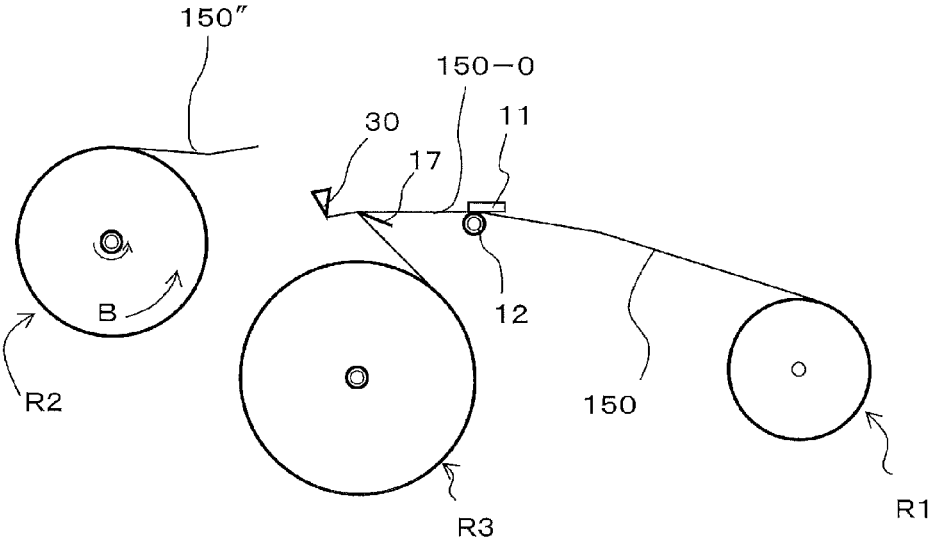
FIG. 11C is an explanatory view showing the tape feeding, cutting, take-up behavior, and the like during printed matter production.

Then, the flow proceeds to step S270, and the CPU 212 outputs a control signal to the motor driving circuit 219, starts the driving of the adhesive take-up motor M2, and starts the take-up of the end edge of the tape 150" with print (refer to FIG. 11C).

Subsequently, in step S275, the CPU 212 determines whether or not a predetermined amount of time has passed since the cutting operation of the cutter mechanism 30 in the above described step S265. If the predetermined amount of time has not passed, the condition is not satisfied (S275: NO), and the flow loops back and enters a standby state. This predetermined amount of time only needs to be a sufficient amount of time for taking up the above described end edge of the tape 150" with print on the above described winding core 41 of the take-up mechanism 40. If the above described predetermined amount of time has passed, this condition is satisfied (S275: YES), and the flow proceeds to step S280.

In step S280, the CPU 212 outputs a control signal to the motor driving circuit 219 and stops the driving of the adhesive take-up motor M2. With this arrangement, the end edge of the tape 150" with print generated by the above described cutting can be reliably taken up.

Once the above described step S280 ends, this flow is terminated.

As described above, in this embodiment, the printing head 11 forms the print part HR for preheating in the border area between the tip end region P1 and the print area P2 prior to formation of desired print in the print area P2, thereby making it possible to execute print formation in the above described print area P2 in a sufficiently warmed up state due to the formation operation. As a result, it is possible to suppress the occurrence of faint print and the like, and improve print quality. This makes it possible to suppress the occurrence of defective products in the above described printed matter generated by take-up.

Further, in addition to the above, due to the above described print part HR for preheating, the border between the tip end region P1, which is the tape section mainly used for connection to the winding core 41 and not provided for substantial use by the user, and the print area P2 which serves as the tape section substantially provided for use by the user, can be visually clearly defined.

Further, in particular, according to this embodiment, it is possible to form printed matter related information in the tip end region P1 separated from the print area P2 via the print part HR for preheating and effectively utilize the tip end region P1 as an information display area. For example, in a case where the notation characters L1 ("↑↑↑↑ To Here") that emphasize the separation by the print part HR for preheating are formed as the printed matter related information as shown in the above described FIG. 8A and FIGS. 10A and 10B, it is possible to visually clearly define the above described print area P2, which is the tape section substantially provided for use by the user, in a reliable manner.

Further, in a case where printed matter identification information (the notation characters L2 which include the control number and the like in the aforementioned example) is formed as the printed matter related information as shown in the above described FIG. 8B and FIG. 10B, it is possible to improve the convenience of control of the winding core 41 when the tape 150" with print is fed out and depleted from the second roll R2 during use by the user. Or, if contact information such as a homepage address is formed as the printed matter related information, it is also possible to improve convenience when an additional purchase is to be made in the above described case where the tape 150" with print is depleted.

Note that various modifications may be further made without deviating from the spirit and scope of the present disclosure. The following describes such modifications.

(1) In a Case where the Print Mode of the Print Part for Preheating is Changed in Accordance with the Temperature of the Printing Head According to this modification, the temperature sensor SR for detecting the temperature of the printing head 11 is disposed (refer to the aforementioned FIG. 6). Then, the above described CPU 212 controls the heating elements of the printing head 11 via the printing head control circuit 221 and changes the print mode of the above described print part HR for preheating in accordance with the temperature of the printing head 11 detected by this temperature sensor SR.

Figure 14A:
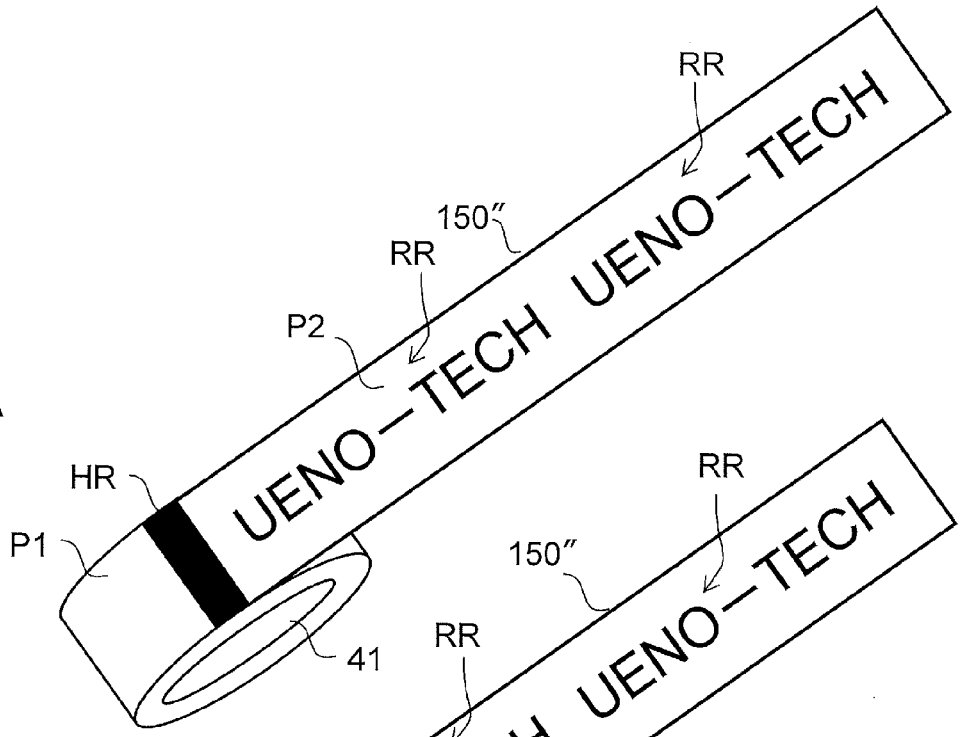
FIG. 14A is an explanatory view showing a modification in which the print part for preheating is changed in accordance with the temperature of the printing head.

For example, if the temperature of the printing head 11 detected by the temperature sensor SR is normal, the CPU 212 controls the printing head 11 so that a relatively thin print part HR for preheating (having a small width dimension along the tape longitudinal direction) is formed, as shown in the FIG. 14A similar to the above described FIG. 8 and FIG. 10.

Figure 14B:
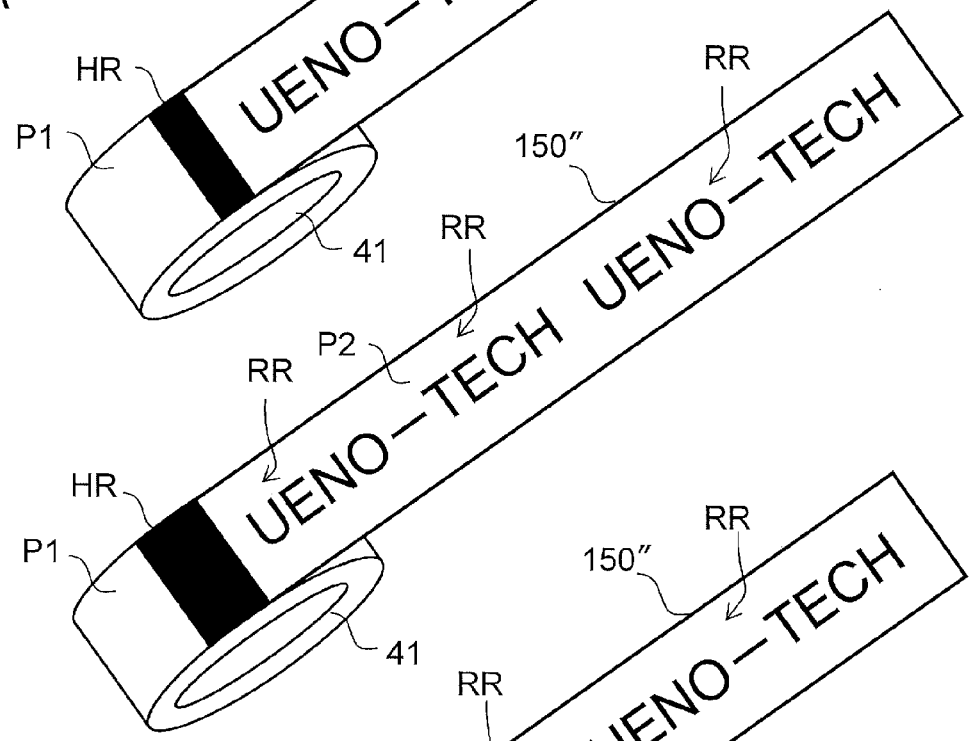
FIG. 14B is an explanatory view showing a modification in which the print part is changed in accordance with the temperature of the printing head.

Further, if the temperature of the printing head 11 detected by the temperature sensor SR is relatively low (lower than a predetermined first threshold value, for example), the CPU 212 controls the printing head 11 so that a relatively thick print part HR for preheating (having a large width dimension along the tape longitudinal direction) is formed, as shown in FIG. 14B. Note that the print mode is not limited to the above described thick width as long as the mode is one in which the print surface area becomes relatively large.

Figure 14C:
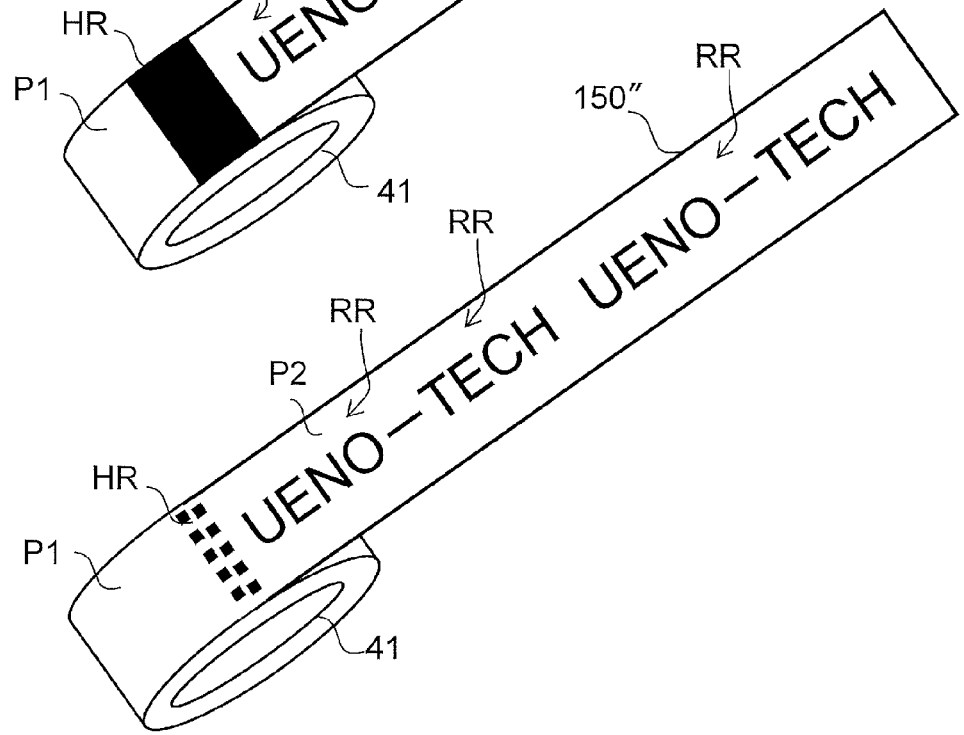
FIG. 14C is an explanatory view showing the modification in which the print part is changed in accordance with the temperature of the printing head.

Furthermore, if the temperature of the printing head 11 detected by the temperature sensor SR is relatively high (higher than a predetermined second threshold value, for example), the CPU 212 controls the heating elements of the printing head 11 so that the print part HR for preheating having a checkered pattern is formed, as shown in FIG. 14C. Note that the print mode is not limited to the above described checkered pattern as long as the mode is one in which the print surface area becomes relatively small (the print mode may be shading or the like, for example).

Variable control of the print mode such as described above in this modification is executed by the CPU 212 during printing of the print part HR for preheating in the above described step S208.

As described above, according to this modification, if the temperature of the printing head 11 is relatively low, the surface area of the print part HR for preheating is widened, making it possible to perform more reliable preheating. Conversely, if the temperature of the printing head 11 is relatively high, the surface area of the print part HR for preheating is narrowed and the print formation density is decreased, making it possible to not use wasteful energy more than necessary.

(2) In a Case where a Test Pattern is Formed

Figure 15A:
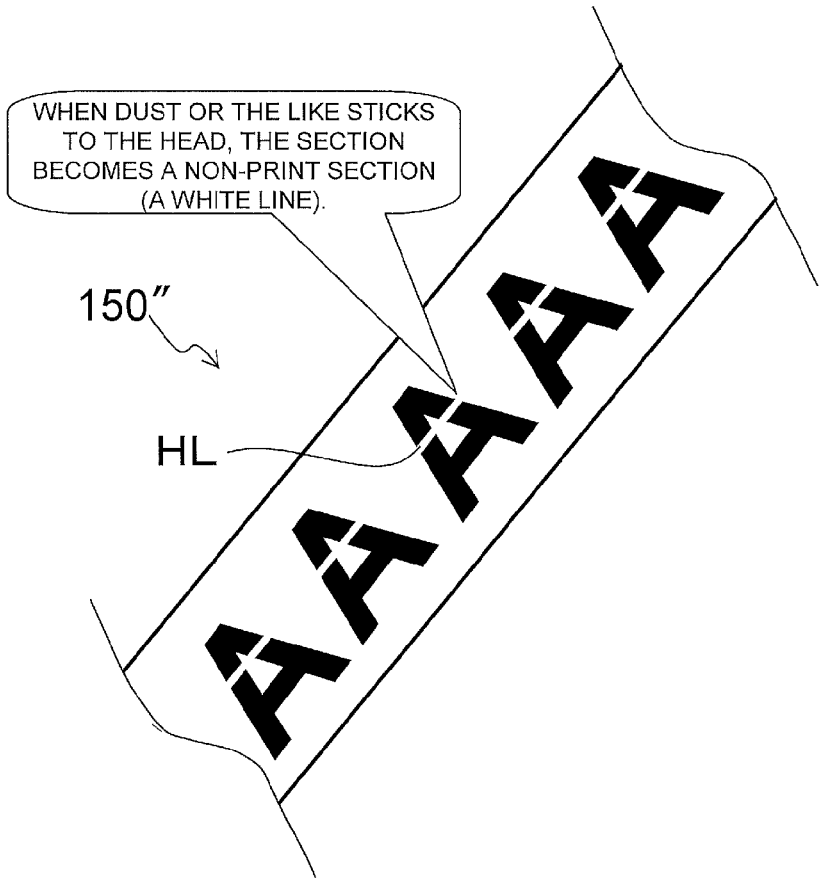
FIG. 15A is a perspective view of a tape with print in a comparison example with respect to a modification in which a test pattern is formed.
Figure 15B:
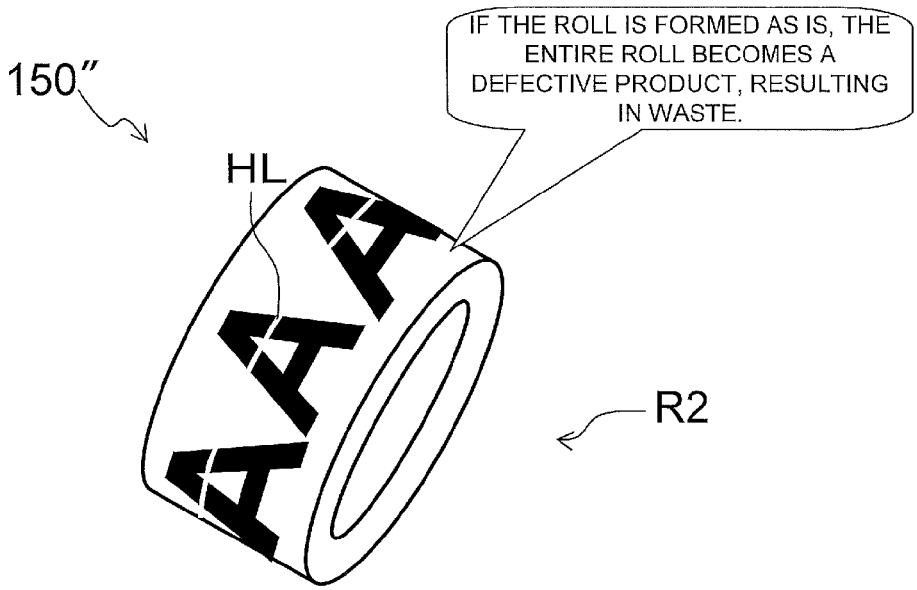
FIG. 15B is a perspective view of a generated second roll in the comparison example with respect to the modification in which a test pattern is formed.

Furthermore, a predetermined test pattern (not shown) may be printed as the above described printed matter related information. That is, as described above, in a case where print formation is performed by the printing head 11, faint print or the like may occur due to attached matter, such as dust, on the printing head 11 or nearby area, for example, causing a decrease in print quality. For example, as a comparison example of this modification, when dust or the like sticks to the printing head 11 or nearby area, the above described faint print or partial omission may occur in a section (a portion of the characters "AAA" in this example) of print formation corresponding to the above described stuck section on the above described tape 150" with print, resulting in a so-called white line HL (non-print section), as shown in FIG. 15A. Then, if the second roll R2 is produced by take-up of the tape 150" with print as described above and the above described white line is found after production of the second roll R2 as shown in FIG. 15B, the second roll R2 generated by take-up becomes an entirely defective product, resulting in waste.

Figures 16A, 16B, 16C, 16D:
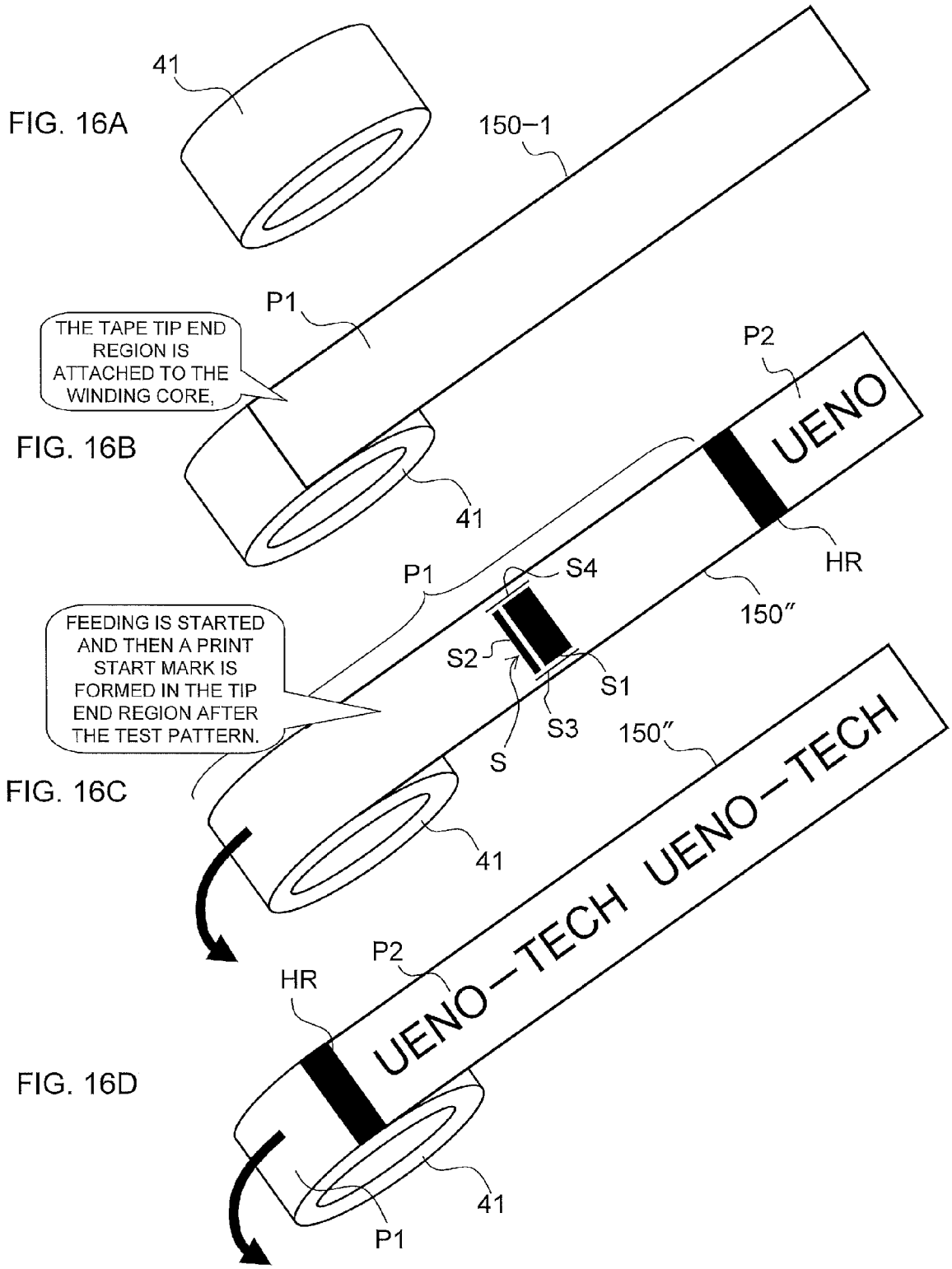
FIG. 16A is an explanatory view showing the behavior of attaching a tip end region of the tape to the winding core and performing printing in a modification in which a test pattern is formed.
FIG. 16B is an explanatory view showing the behavior of attaching the tip end region of the tape to the winding core and performing printing in the modification in which a test pattern is formed.
FIG. 16C is an explanatory view showing the behavior of attaching the tip end region of the tape to the winding core and performing printing in the modification in which a test pattern is formed.
FIG. 16D is an explanatory view showing the behavior of attaching the tip end region of the tape to the winding core and performing printing in the modification in which a test pattern is formed.

Hence, according to this modification, whether or not the print quality has decreased due to the occurrence of the white line HL or the like can be visually confirmed before production of the second roll R2 is actually started. Specifically, according to this modification, after a predetermined test pattern S (refer to FIG. 16 and FIG. 17 described later) is formed into print on the print-receiving tape 150 by the printing head 11, tape take-up and feeding are performed. Then, the user visually confirms the quality of the test pattern S from outside the apparatus, making it possible to visually confirm whether or not the print quality has decreased due to the occurrence of the above described white line HL or the like. At this time, a visual confirmation window (not shown) enabling visual confirmation of the tape 150" with print taken up by the take-up mechanism 40 may be disposed near the frontward-side end of the frontward-side opening/closing cover 9, for example, for the above described visual confirmation. In this case, after formation of the above described test pattern S, feeding is controlled so that the area where the test pattern S of the tape 150" with print has been formed arrives and stops near the above described visual confirmation window.

That is, according to this modification, after the tip end region P1 (an area connected to the winding core 41 on the tip end side of a print area P2 described later) of the tape 150-1 is attached to the above described winding core 41 by the user (refer to FIG. 16A and FIG. 16B) and the aforementioned preparation processing is performed, print formation of the above described test pattern S and take-up of the tape 150" with print are started.

In this example, the test pattern S is a pattern that includes a thick line S1 that extends in the tape width direction, a thin line S2 that extends in the tape width direction, and end lines S3, S4 that extend in the tape transport direction on both tape width direction sides of the lines S1, S2, respectively. In this example, the lengths of the lines S1, S2 in the tape width direction are substantially the same. Further, the width between the above described end lines S3, S4 is substantially the same as the tape width direction dimension (more accurately, the tape width direction dimension in the area heated by the heating elements) of the printing head 11. If the user visually (through the visual confirmation window, if the aforementioned visual confirmation window exists,) confirms the occurrence of the above described white line HL (the line S1 and the line S2 are divided by the white line HL, for example), it is possible to recognize that dust or the like is stuck on the printing head 11. In such a case, the user can avoid the aforementioned waste by cleaning the printing head 11 or the like (without continuing production of the second roll R2 as is, for example), and then producing the second roll R2.

If the user visually confirms non-occurrence of the above described white line HL in the test pattern S formed on the tape 150" with print as shown in the figure, the user can regard the printing head 11 as clean and continue production of the second roll R2 as is. That is, according to this modification, it is possible to utilize the test pattern S as auxiliary information related to whether or not the aforementioned print quality is good.

Figure 17A:
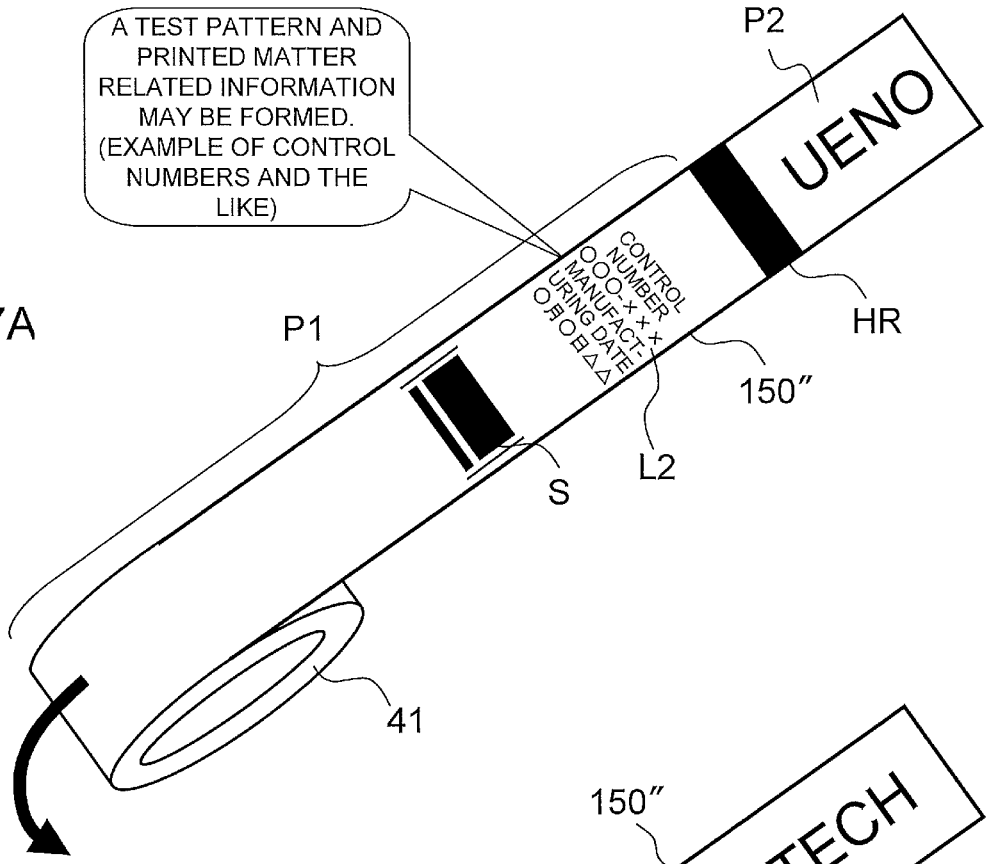
FIG. 17A is an explanatory view showing printed matter related information formed in the tip end region.
Figure 17B:
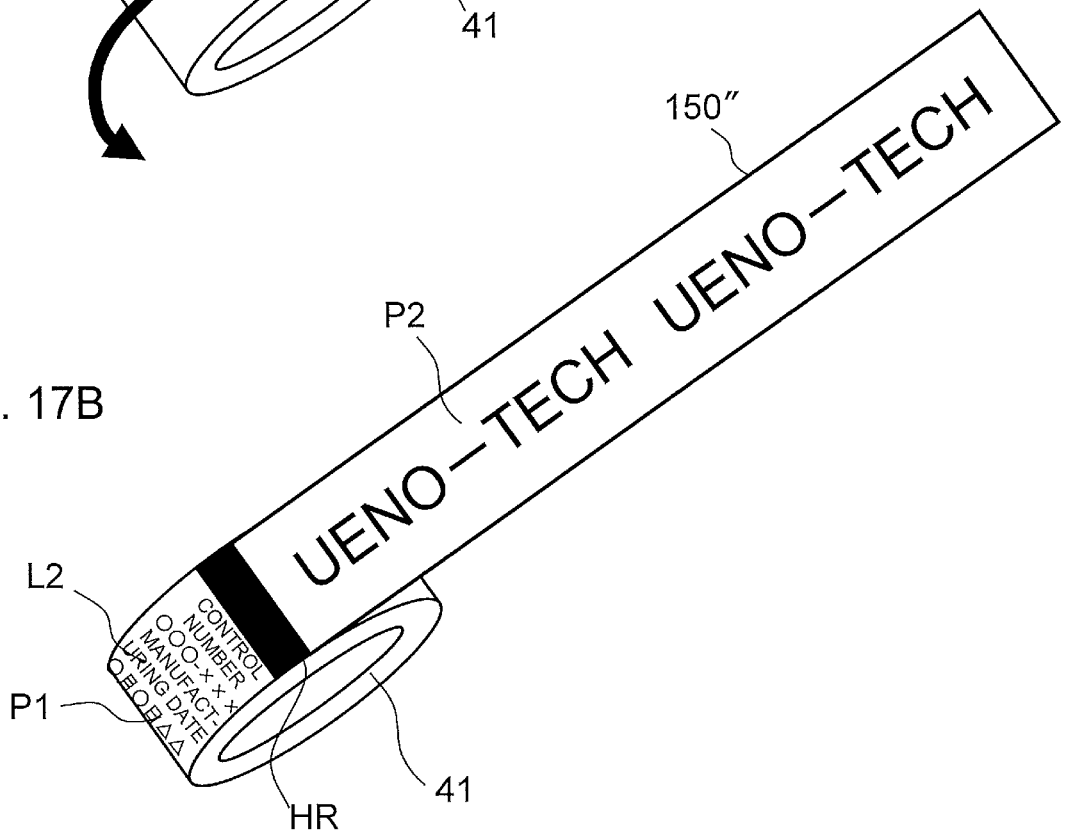
FIG. 17B is an explanatory view showing printed matter related information formed in the tip end region.

Note that, as shown in FIG. 17A and FIG. 17B, both the above described test pattern S and the above described notation characters L2 (refer to the aforementioned FIGS. 8A and 8B) such as the control number (so-called serial number and the like) and manufacturing date and the like serving as the printed matter related information may be printed in the tip end region P1. In this example, the above described notation characters L2 are formed further on the transport direction upstream side than the test pattern S, and the above described print part HR for preheating is formed further on the transport direction upstream side than the above described notation characters L2. In this case, the above described tip end region P1 separated from the print area P2 via the above described print part HR for preheating can be effectively utilized as a suitable information display area as described above.

(3) Variations of Test Pattern and Print Part for Preheating

Figure 18:
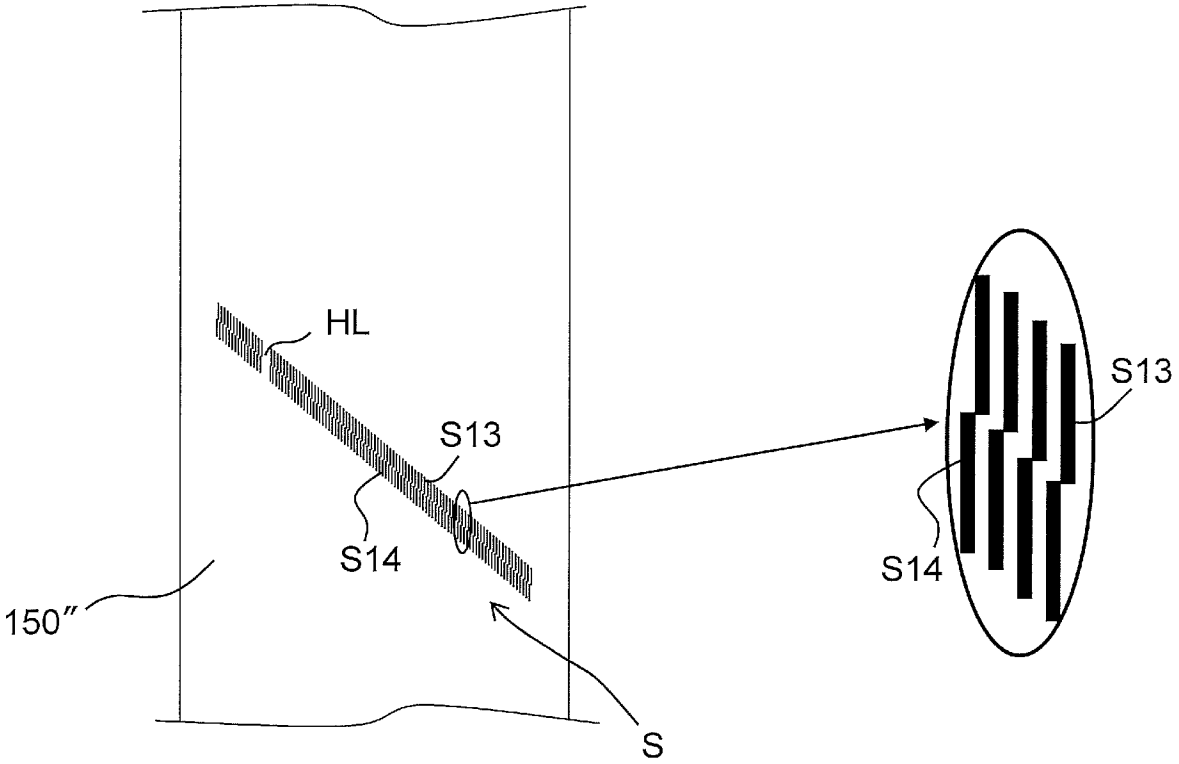
FIG. 18 is an explanatory view showing a modification in which a test pattern that extends diagonally at large is formed into print by staggering two patterns.

While the test pattern S includes a pattern that includes the lines S1, S2 and the end lines S3, S4 in the above, the present disclosure is not limited thereto, allowing other modes as well. FIG. 18 shows such an example.

In FIG. 18, according to the test pattern S in this example, a great number of first patterns S13 that comprise a predetermined transport direction dimension and a predetermined width direction dimension and extend in the transport direction (in other words, the longitudinal direction; hereinafter the same) is disposed. At this time, the two adjacent first patterns S13, S13 are disposed at a predetermined pitch (substantially the same pitch as the above described width direction dimension in this example), and the transport direction position of each is shifted (in accordance with the above described diagonally extended direction). Furthermore, a great number of the second patterns S14 that comprise the same above described predetermined transport direction dimension and the above described predetermined width direction dimension as the above described first pattern S13, and extend in the transport direction is disposed. Two adjacent second patterns S14, S14 are also disposed at a predetermined pitch (substantially the same pitch as the above described width direction dimension in this example), and the transport direction position of each is shifted (in accordance with the above described diagonally extended direction). Then, the above described first pattern S13 and second pattern S14 are alternately staggered so that the position of one second pattern S14 in the tape width direction is in a tape width direction position in the blank area between the two adjacent above described first patterns S13, S13 (and similarly the position of one first pattern S14 in the tape width direction is in a tape width direction position in the blank area between the two adjacent above described second patterns S14, S14).

In the configuration in FIG. 18, there is always a blank area where printing is not performed on both outer sides of one first pattern S13 and one above described second pattern S14 in the tape width direction. As a result, the energy resulting from the heat from the heating elements is distributed, and fill-in between the first pattern S13 and the second pattern S14 does not occur. That is, if there is a solid black region without such a blank area as described above, print blurring may occur and, in that case, the user may have difficulty visually confirming the above described white line HL. Conversely, according to the configuration in FIG. 18, such print blurring does not occur. Further, one second pattern S14 always exists in the tape width direction position corresponding to the blank area between the two adjacent first patterns S13, S13, and one first pattern S13 always exists in the tape width direction position corresponding to the blank area between the two adjacent second patterns S14, S14. That is, all heating elements that execute print formation on the print-receiving tape 150 among the heating elements of the printing head 11 form either the entire first pattern S13 or the entire second pattern S14, and are therefore always energized (turned ON) once. As a result, if faint print occurs due to dust or the like stuck to the above described printing head 11, the faint print reliably appears as the white line HL without exception (the white line HL always occurs in either the first pattern S13 or the second pattern S14). As a result, the user can reliably recognize the location of occurrence of the white line HL. In particular, the user can easily determine whether or not the above described faint print exists since the pattern is a simple geometrical pattern made of the first pattern 13 and the second pattern 14. Note that, from the point of ensuring the above described reliable recognition by the user, the first pattern S13 and the second pattern S14 preferably comprise a measurable width direction dimension (at least 4 dots, for example) and longitudinal direction dimension (30 dots, for example).

Note that, similarly, while the print part HR for preheating is formed as a blackened region in the aforementioned example, the present disclosure is not limited thereto, and the print part HR for preheating may be formed as a pattern that extends diagonally at large by staggering two patterns in the same manner as described above.

(4) Other

Note that, in the above, the arrows shown in FIG. 6 denote an example of signal flow, but the signal flow direction is not limited thereto.

Also note that the present disclosure is not limited to the procedures shown in the above described flows of the flowcharts in FIG. 12 and FIG. 13, and procedure additions and deletions as well as sequence changes and the like may be made without deviating from the spirit and scope of the disclosure.

Further, other than that already stated above, techniques based on the above described embodiments and each of the modifications may be suitably utilized in combination as well.

What is claimed is:

1. A printer comprising:

a feeder configured to feed a recording medium;

a printing head configured to form desired print in a predetermined print area of said recording medium fed by said feeder;

a take-up body configured to sequentially take up said recording medium on an outer circumference part with a tip end region of said recording medium positioned on a downstream side from said print area in a transport direction, said tip end region being connected to said outer circumference part, and said take-up body is further configured to produce roll-shaped printed matter; and a print control portion configured to control said printing head so as to form, during preheating of said printing head, a print part in a position that serves as a border between said tip end region and said print area of said recording medium.

2. The printer according to claim 1, wherein:

said print control portion is configured to control said printing head so as to form said print part that comprises a plurality of first patterns that extend along a longitudinal direction of said recording medium, each disposed at a predetermined pitch in a width direction of said recording medium, and a plurality of second patterns that extend along a longitudinal direction of said recording medium, each disposed at said predetermined pitch in the width direction of said recording medium, wherein said first pattern and said second pattern are alternately arranged in a staggered manner so that a position of one second pattern in said width direction matches the position of a blank area in said width direction, the blank area being between two adjacent first patterns.

3. The printer according to claim 1, further comprising:

a temperature detecting device configured to detect a temperature of said printing head, wherein:

said print control portion is configured to control said printing head so as to change a print mode of said print part in accordance with a temperature of said printing head detected by said temperature detecting device.

4. The printer according to claim 3, wherein:

said print control portion is configured to control said printing head so as to form said print part in a print mode in which a print surface area of said print part becomes relatively large in a case that a temperature of said printing head detected by said temperature detecting device is lower than a predetermined first threshold value.

5. The printer according to claim 3, wherein:

said print control portion is configured to control said printing head so as to form said print part in a print mode in which a print surface area of said print part becomes relatively small in a case that a temperature of said printing head detected by said temperature detecting device is higher than a predetermined second threshold value.

6. The printer according to claim 1, wherein:

said print control portion is configured to control said printing head so as to form a predetermined test pattern or printed matter related information in relation to said printed matter in said tip end region.

7. The printer according to claim 6, wherein:

said print control portion is configured to control said printing head so as to form said test pattern in said tip end region.

8. The printer according to claim 6, wherein:

said print control portion is configured to control said printing head so as to form said printed matter related information in said tip end region.

9. The printer according to claim 6, wherein:

said print control portion is configured to control said printing head so as to form said printed matter related information on an upstream side in the transport direction from said test pattern in said tip end region.

10. The printer according to claim 1, wherein:

said recording medium is layered, from a first side in a thickness direction toward a second side, in order of: a print-receiving layer, a base layer, an adhesive layer, and a separation material layer, and the printer further comprises a take-up portion configured to take up said separation material layer separated from said recording medium.

11. A printer comprising:

a feeder configured to feed a recording medium;

a printing head configured to form desired print in a predetermined print area of said recording medium fed by said feeder;

a take-up body configured to sequentially take up said recording medium on an outer circumference part with a tip end region of said recording medium positioned on a downstream side from said print area in a transport direction, said tip end region being connected to said outer circumference part, and said take-up body is further configured to produce roll-shaped printed matter; and a print control portion configured to control said printing head so as to form, during preheating of said printing head, a print part in a position that serves as a border between said tip end region and said print area of said recording medium, wherein said print control portion is configured to control said printing head so as to form a predetermined test pattern in said tip end region, and wherein said print control portion is configured to control said printing head so as to form said predetermined test pattern that comprises a plurality of first patterns that extend along a longitudinal direction of said recording medium, each first pattern disposed at a predetermined pitch in a width direction of said recording medium, and a plurality of second patterns that extend along a longitudinal direction of said recording medium, each second pattern disposed at said predetermined pitch in the width direction of said recording medium, wherein said first pattern and said second pattern are alternately arranged in a staggered manner so that a position of one second pattern in said width direction matches the position of a blank area in said width direction, the blank area being between two adjacent first patterns.

* * * * *